US007665576B2

(12) United States Patent
Pelletier

(10) Patent No.: US 7,665,576 B2
(45) Date of Patent: Feb. 23, 2010

(54) MOVABLE SAFETY BARRIER SYSTEM

(76) Inventor: Richard C. Pelletier, 397 Flanders Rd., Coventry, CT (US) 06238

( * ) Notice: Subject to any disclaimer, the term of this patent is extended or adjusted under 35 U.S.C. 154(b) by 825 days.

(21) Appl. No.: 10/983,332

(22) Filed: Nov. 5, 2004

(65) Prior Publication Data

US 2005/0167198 A1 Aug. 4, 2005

Related U.S. Application Data

(60) Provisional application No. 60/517,659, filed on Nov. 6, 2003.

(51) Int. Cl.
*E04D 15/00* (2006.01)

(52) U.S. Cl. ..... 182/45; 52/749.12

(58) Field of Classification Search ..... 182/45, 182/138; 52/749.12
See application file for complete search history.

(56) References Cited

U.S. PATENT DOCUMENTS 3,992,847 A * 11/1976 Heath ..... 52/742.12
4,222,212 A * 9/1980 Alderman ..... 52/749.12
4,557,092 A 12/1985 Brueske
4,828,073 A * 5/1989 Friday ..... 182/36
5,251,415 A 10/1993 Van Auken et al.
5,660,353 A * 8/1997 Adams et al. ..... 242/557
5,778,628 A 7/1998 Pendley
6,003,282 A 12/1999 Alderman et al.
6,094,883 A 8/2000 Atkins
6,195,958 B1 3/2001 Neifer et al.
6,216,416 B1 4/2001 West et al.
6,363,684 B1 4/2002 Alderman et al.
6,401,426 B1 6/2002 Alderman et al.
6,421,980 B1 7/2002 Alderman et al.
6,595,455 B2 7/2003 Romes
6,647,892 B2 * 11/2003 Theurer et al. ..... 104/7.1
D485,657 S * 1/2004 Lewis et al. ..... D34/28
7,008,161 B2 * 3/2006 Wagner ..... 414/10
2002/0124507 A1 9/2002 Atkins

* cited by examiner

*Primary Examiner*—Alvin C Chin-Shue
(74) *Attorney, Agent, or Firm*—Hamilton, Brook, Smith & Reynolds, PC

(57) ABSTRACT

A movable safety barrier system includes a flexible barrier member having a barrier member length with first and second ends, and a width. The barrier member can have a construction that is flexible in both directions along the length and width of the barrier member. First and second end supports are provided which are capable of supporting respective first and second ends of the length of the barrier member when the barrier member is extended between the end supports. The end supports can allow the extended barrier member to move in a direction transverse to the width of the barrier member when desired.

23 Claims, 22 Drawing Sheets

MOVABLE SAFETY BARRIER SYSTEM

RELATED APPLICATION

This application claims the benefit of U.S. Provisional Application No. 60/517,659, filed Nov. 6, 2003. The entire teachings of the above application are incorporated herein by reference.

BACKGROUND

Workers on elevated construction projects, such as roofs, should have protection from falling, for example, while installing roof panels, insulation, fastenings, or other component parts of the roofing system. These workers are at risk of falling in the region extending in front of the installed roof panels. When insulation is spread over structural members ahead of the workers' position, and ahead of the installed roof panels, the layer of insulation can give workers a false sense of security, since the insulation covers the structural members. However, the insulation is not strong enough to prevent a worker from falling through the insulation. One method of providing protection for workers against such falls is to apply netting over the entire roof structure, which is then covered by the insulation and roof panels. This method is not only expensive but the installation of the netting can also be dangerous. Another method of providing protection against falls is to secure safety lines to the workers. This method becomes unwieldy when multiple workers are moving back and forth over the roof, and often the workers end up disconnecting the lines.

SUMMARY

The present invention provides a movable safety barrier system which can be extended over structural members on elevated projects along the leading edge of construction, and can be advanced as the work progresses.

The barrier system can include a flexible barrier member having a barrier member length with first and second ends, and a width. The barrier member can have a construction that is flexible in both directions along the length and width of the barrier member. First and second end supports are provided which are capable of supporting respective first and second ends of the length of the barrier member when the barrier member is extended between the end supports. The end supports can allow the extended barrier member to move in a direction transverse to the width of the barrier member when desired.

In particular embodiments, the flexible barrier member can be extended across support members of a structure. The flexible barrier member can be made of netting material which can be a slippery plastic mesh-type material. The width of the flexible barrier member has a leading edge which can be reinforced to allow the barrier member to slide more evenly across the support members of the structure. The leading edge can be reinforced with a thin plastic member. The flexible barrier member can extend from at least one end from a roll. When at least one end of the flexible barrier member extends from a roll, the roll can be connected to a windup/unwind mechanism that is capable of locking in selected positions for selecting the tension of the barrier member.

First and second movable carriages can be employed for maintaining a fixed distance between the first and second ends of the length of the flexible barrier member when extended. The first and second carriages can move along selected support members of the structure. Each carriage can include a roller system for engaging and traveling along at least one selected support member of the structure. The roller system can include a series of side rollers and top rollers. Selected rollers are adjustable for adjusting to different sizes and spacings of the support members of the structure. The roller system can include at least one roller assembly for capturing and traveling along a selected support member of the structure. The at least one roller assembly can include opposed side rollers, and top rollers. The position of the at least one roller assembly can be adjustable relative to the carriage.

In one embodiment, first and second cables can be included to which the first and second ends of the length of the flexible barrier member are slidably secured, respectively. The barrier member is capable of sliding along the first and second cables in the direction transverse to the width of the barrier member. The first and second cables are retained by the carriages in the general region of the barrier member for maintaining the fixed distance between the first and second ends of the length of the barrier member when extended.

In another embodiment, the first and second ends of the length of the barrier member can be fixed to the first and second carriages, respectively. Each carriage can be generally triangular in shape. The flexible barrier member can extend over two sides of the triangle. The two sides can have recessed top surfaces to allow the barrier member to extend closer to the supports of the structure.

The present invention also provides a movable safety barrier system including a flexible barrier member having a barrier member length with first and second ends, and a width. The barrier member can extend from at least one end, from a roll. First and second end supports are provided which are capable of supporting respective first and second ends of the length of the barrier member when the barrier member is extended between the end supports. The end supports can allow the extended barrier member to move in a direction transverse to the width of the barrier member when desired. A windup/unwind mechanism can be connected to the roll and is capable of locking in selected positions for selecting the tension of the barrier member.

The present invention further provides a method of providing protection against falls with a movable safety barrier system when installing construction components over support members of a structure. A flexible barrier member can be positioned over the support members of the structure. The flexible barrier member has a barrier member length with first and second ends, and a width. The barrier member can have a construction that is flexible in both directions along the length and width of the barrier member. The width of the barrier member can be extended forward of a leading edge of construction. Respective first and second ends of the length of the barrier member can be supported while the barrier member is extended between first and second end supports. The end supports can allow the extended barrier member to move in a direction transverse to the width of the barrier member when desired. The construction components can be positioned over the support members of the structure with portions extending over part of the barrier member. The position of the barrier member can be moved forward by an amount that allows additional construction components to be positioned over the support members of the structure with portions extending over a part of the barrier member, while the width of the barrier member still extends forward of the construction components.

Embodiments of the movable safety barrier system can be easily and quickly set up and placed into position on a construction project, and can be quickly dismantled for reuse, thereby being economical. Once in place, the safety barrier system can be easily moved by the workers as the construction progresses.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
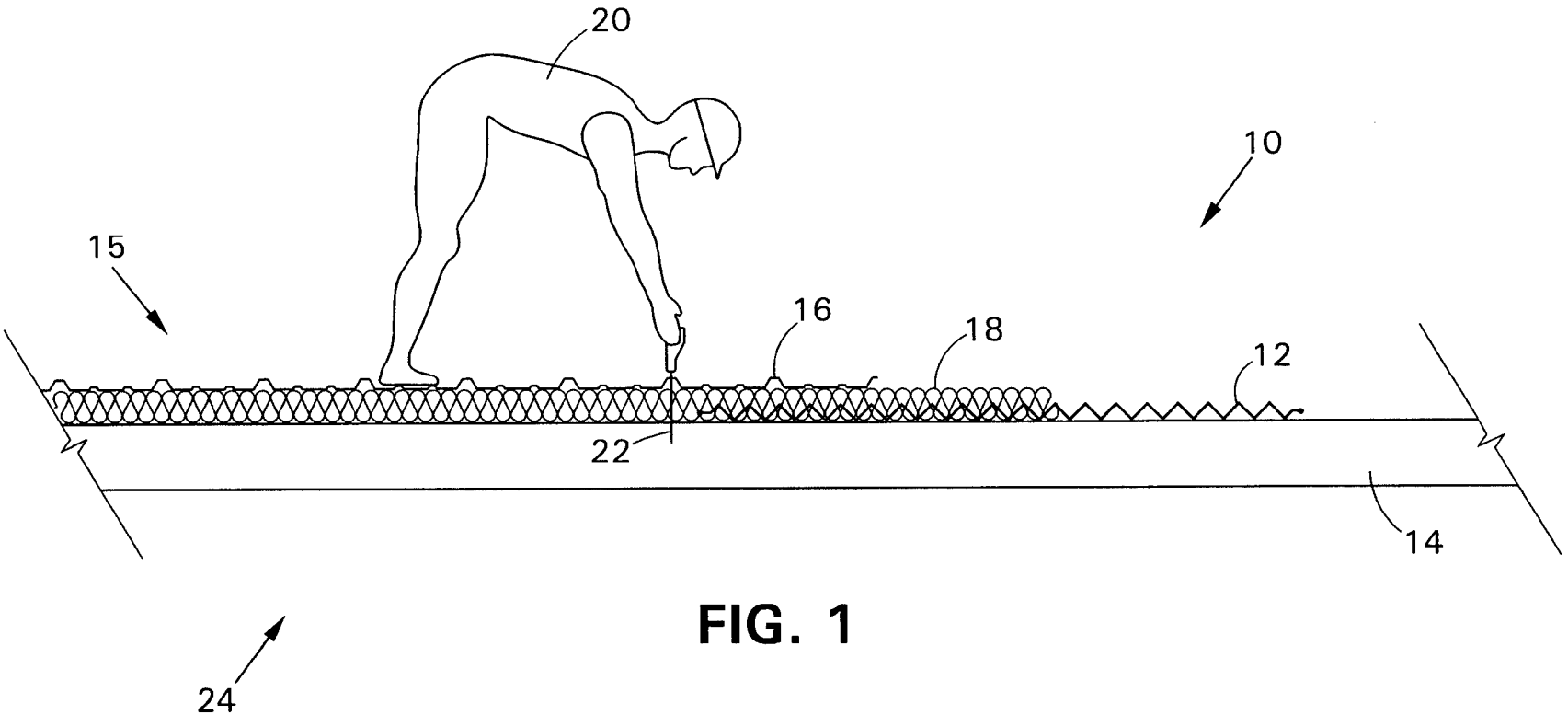
FIG. 1 is a schematic drawing of a worker securing a roof panel in place with a barrier member of an embodiment of a movable safety barrier system in the present invention being in position under the leading edge of insulation and roofing.

Referring to FIG. 1, movable safety barrier system 10 is an embodiment in the present invention which can be extended over elevated structures undergoing construction for catching and preventing a worker 20 from falling to the ground. In the application shown in FIG. 1, the elevated structure is the roof 15 on a building 24, but it is understood that the elevated structure can be other structures, for example, elevated platforms, elevated roads, bridges, etc. In the example shown in FIG. 1, a flexible safety barrier sheet member 12 of the barrier system 10 extends over the roof support members or beams 14 of the building 24 along the leading edge of construction. In this example, the roof 15 includes a layer of insulation 18 and a series of roof panels 16 which are secured to the support beams 14. The barrier member 12 extends under the leading edge of the insulation 18 and roof panels 16. The worker 20 is shown securing a row of roof panels 16 and insulation 18 to the support beams 14 with fasteners 22. Since the barrier member 12 is incrementally moved forward, the fasteners 22 are inserted at a location short of the barrier member 12 so as not to fasten the barrier member 12 to the support beam 14. The barrier member 12 extends under a region covered solely by the insulation 18 to a position ahead of the insulation 18. As a result, if the worker 20 happens to step through or beyond this region of insulation 18, the barrier member 12 will catch the worker 20 and prevent the worker 20 from falling.

Figure 2:
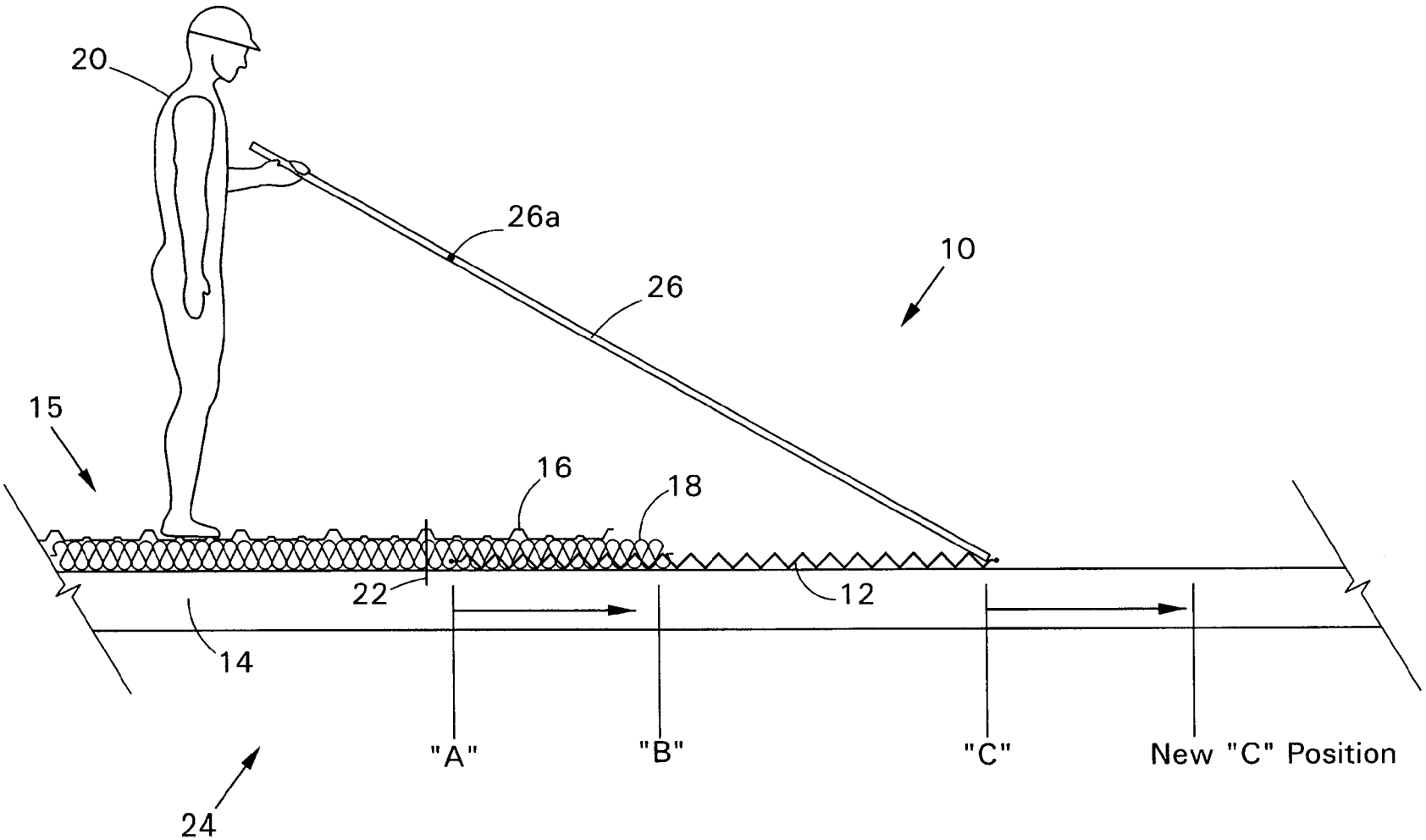
FIG. 2 is a schematic drawing of the worker advancing the barrier member forward to a new position.

Referring to FIG. 2, as work progresses, the worker 20 then advances the position of the barrier member 12 so that the trailing edge at position "A" is moved, for example, by a pole 26, to the edge of the insulation 18 at position "B", and the leading edge at position "C" is moved forward to the new position "C". This slides the barrier member 12 forward under the insulation 18 and positions the barrier member 12 in the proper location for continued installation of insulation 18 and roof panels 16. The pole 26 can have structures at the distal end for gripping or catching the barrier member 12, such as a hook or other suitable gripping protrusions. In addition, the pole 26 can have a marker **26*a* located at a position on the pole 26 corresponding to the distance that the barrier member 12 should be advanced relative to the roof panels 16, to act as a guide for the worker 20**.

Figure 3:
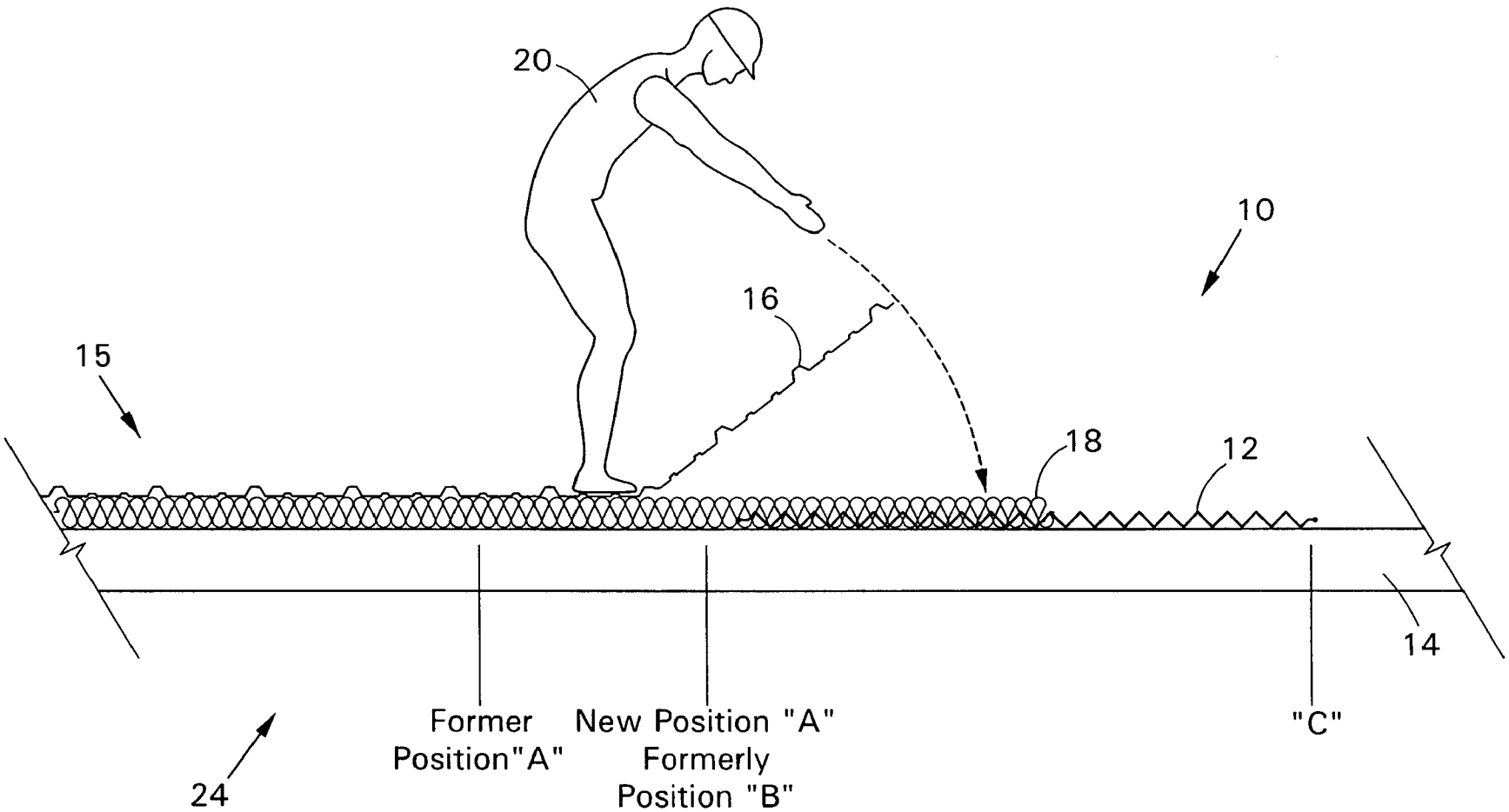
FIG. 3 is a schematic drawing of the worker placing a roof panel over insulation covering the new position of the barrier member.
Figure 4:
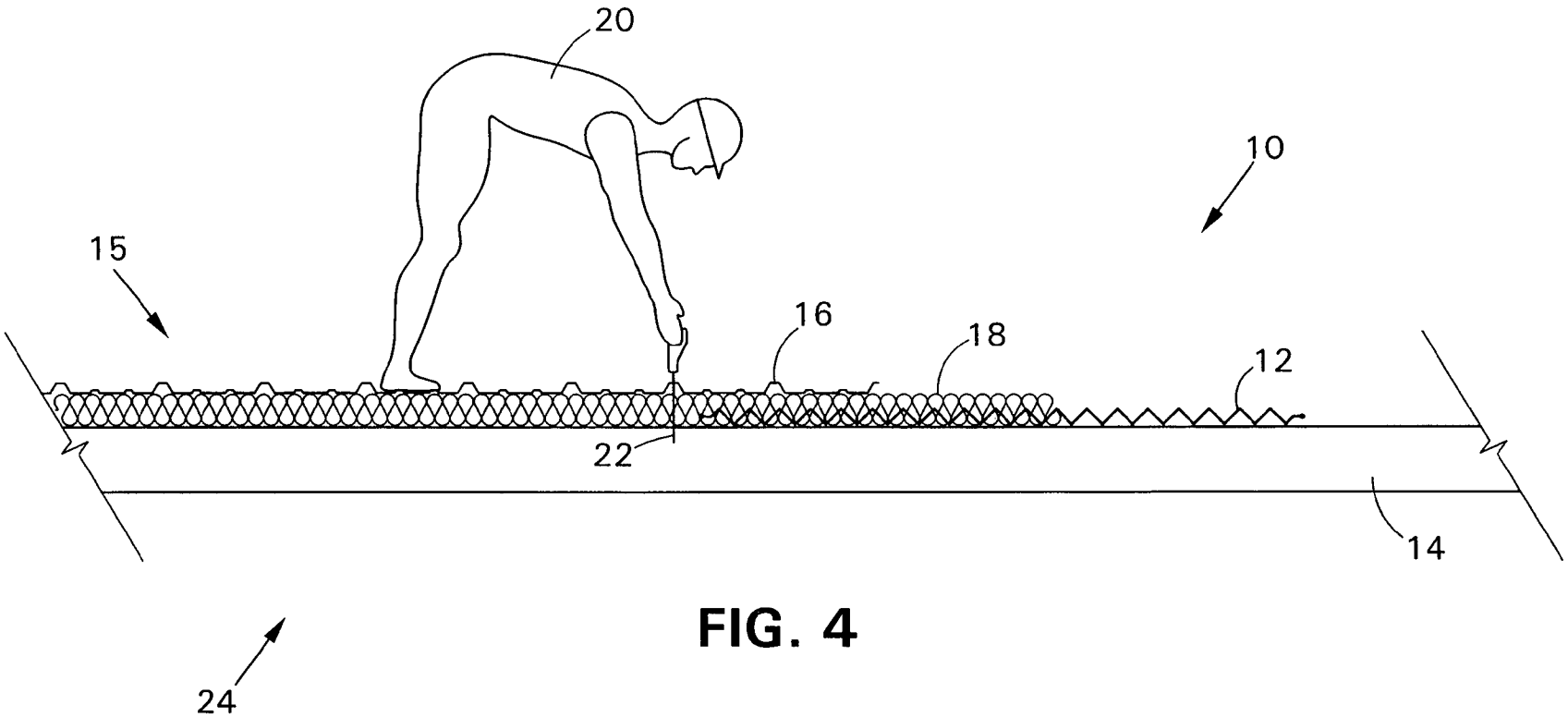
FIG. 4 is a schematic drawing of the worker securing the new roof panel in place.

Referring to FIG. 3, another row of insulation 18 and roof panels 16 are placed over the barrier member 12 and the support beams 14. As seen, the trailing edge of the barrier member 12 has moved from the former position "A" to the former position "B", now becoming the new position "A". The leading edge of the barrier member 12 has moved to a new position "C" ahead of the insulation 18 and roof panels 16 so as to provide protection for the worker 20 against falling. Referring to FIG. 4, the worker 20 then fastens the new roof panels 16 and insulation 18 to the support beams 14 just short of the barrier member 12.

Figure 5:
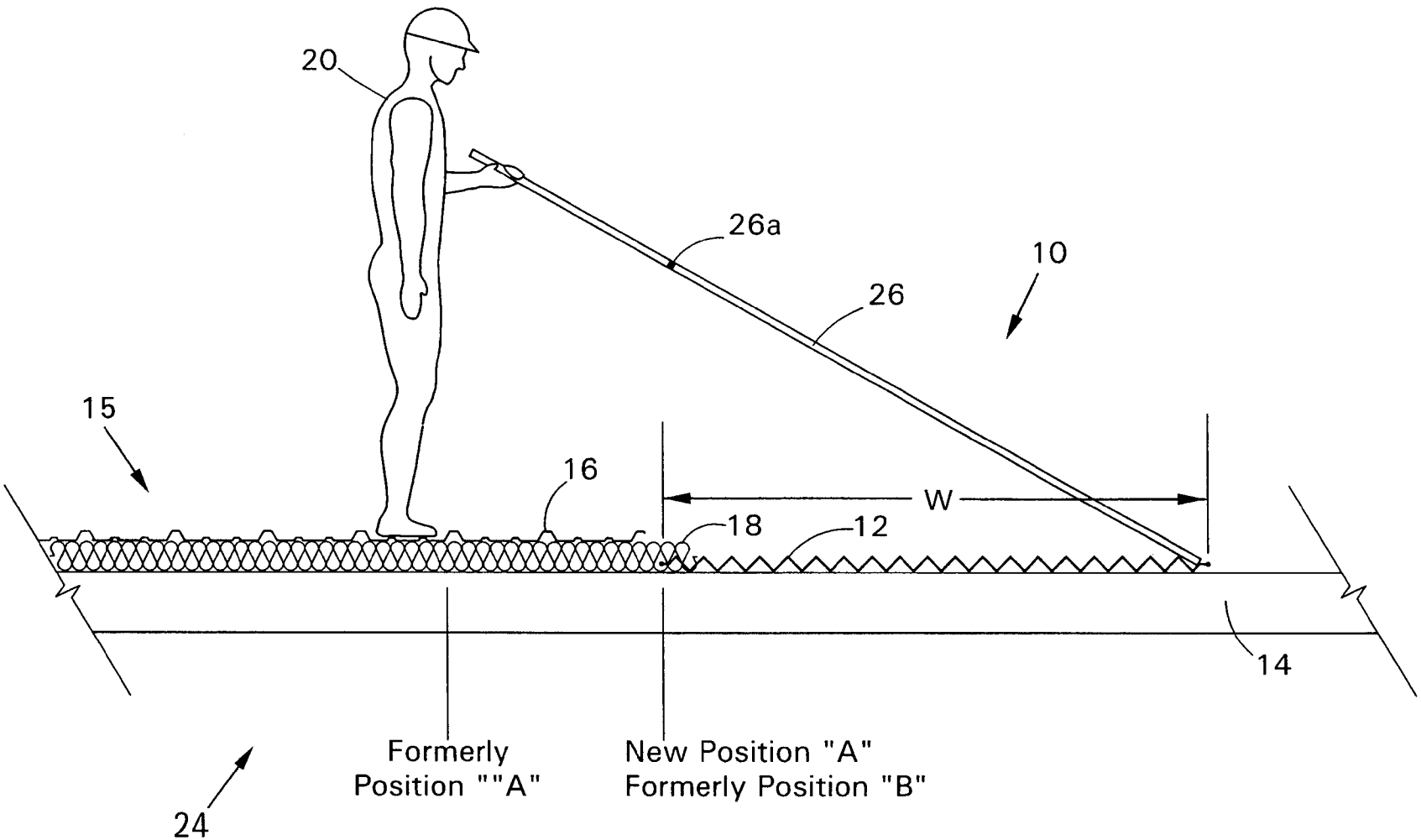
FIG. 5 is a schematic drawing of the worker again advancing the barrier member forward to a new position.
Figure 6:
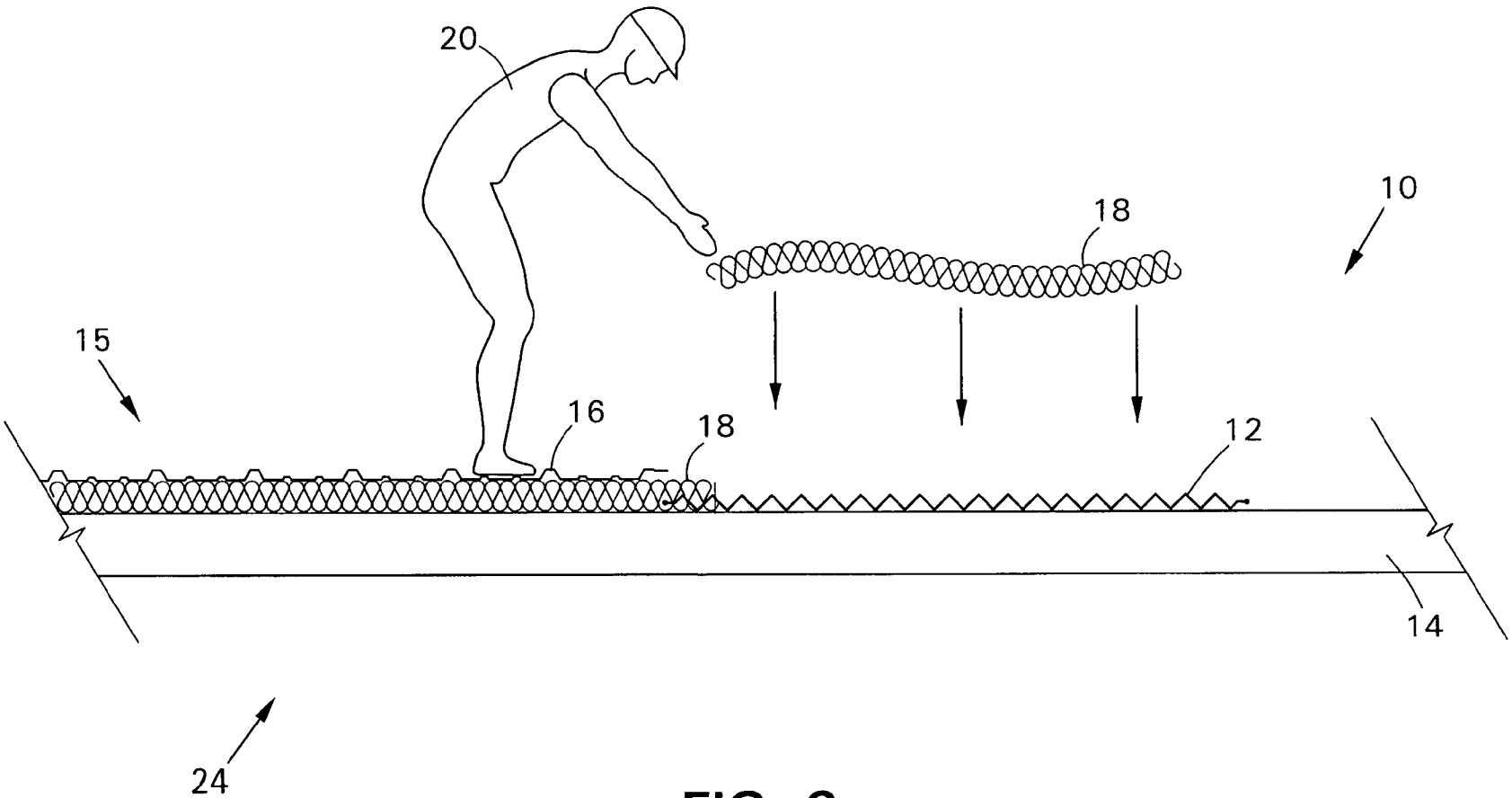
FIG. 6 is a schematic drawing of the worker placing insulation over the barrier member in its new position.

Referring to FIG. 5, the worker 20 again advances the barrier member 12 forward, which moves the trailing edge of the barrier member 12 to a new position "A" near the edge of the insulation 18 and roof panel 16. Almost all of the width "W" of the barrier member 12 extends forward relative to the edge of the construction. Referring to FIG. 6, the worker 20 then places another row of insulation 18 in position, which extends over a portion of the barrier member 12, and the process continues. Once the roof 15 is near completion, the safety barrier system can be removed from the roof 15 for reuse on another project.

Figure 7:
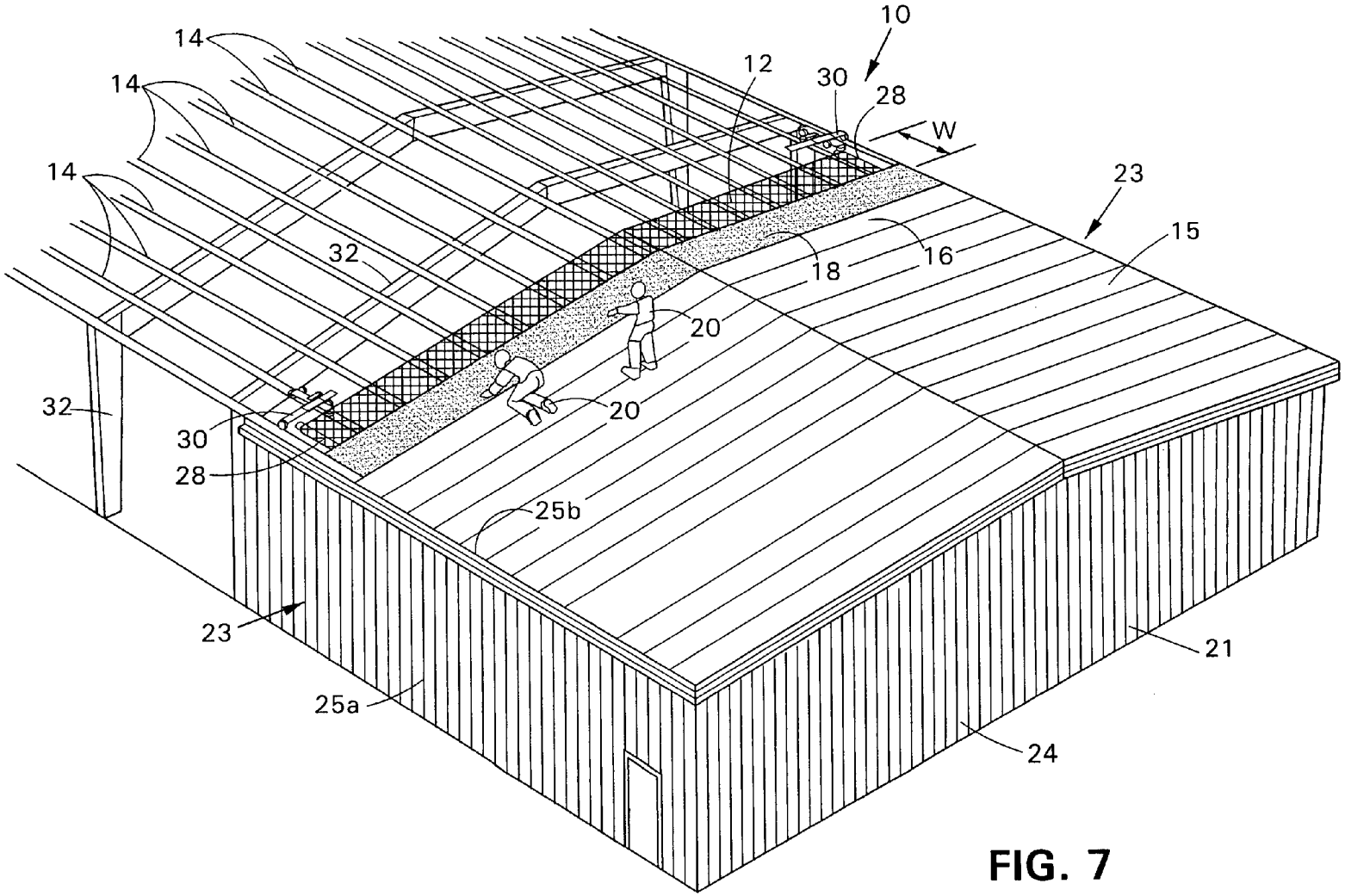
FIG. 7 is a perspective view of a roof being installed on a building with the movable safety barrier system in position at the leading edge of construction.
Figure 8:
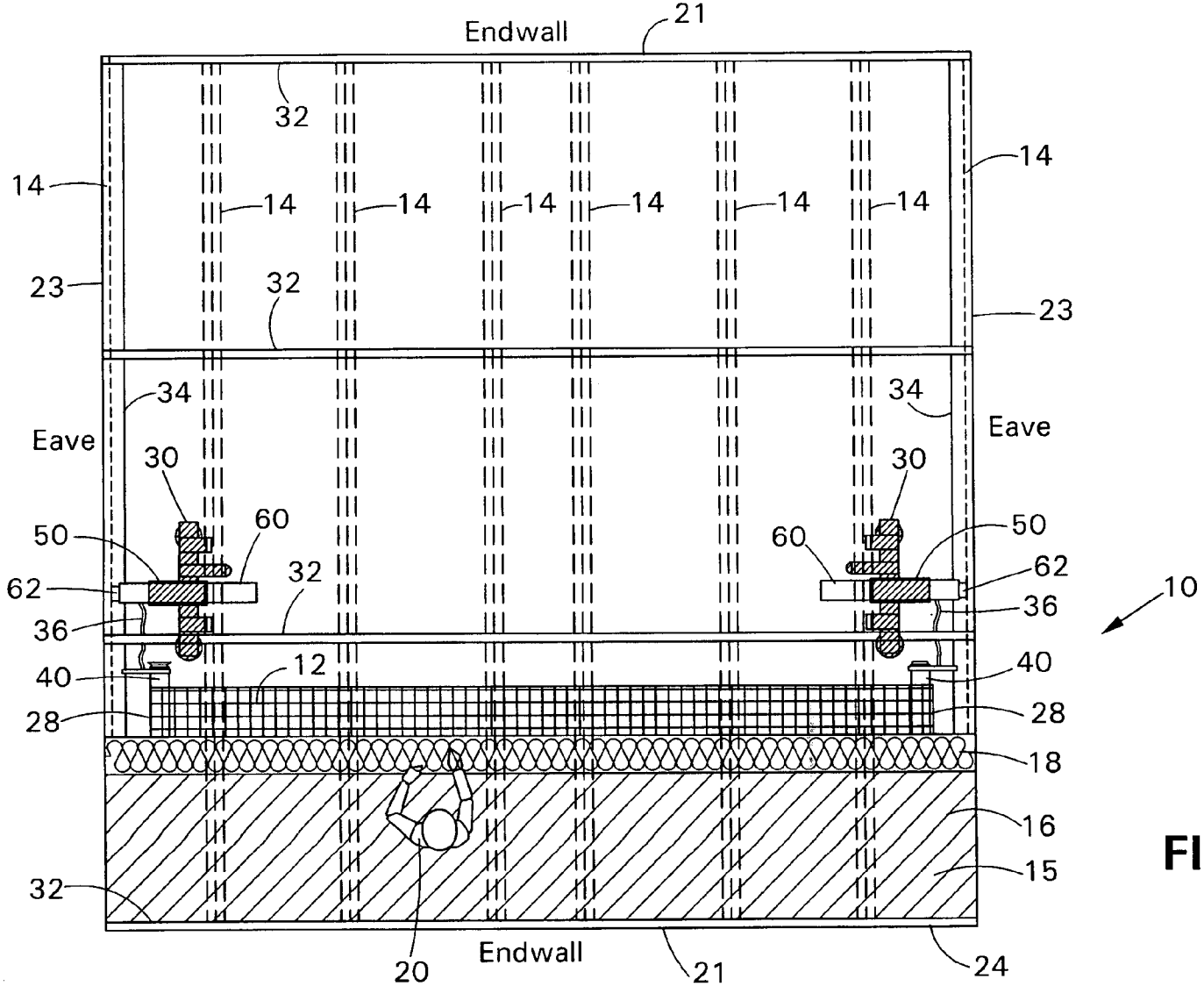
FIG. 8 is a top view of a roof being installed on a building with the movable safety barrier system in position at the leading edge of construction.
Figure 9:
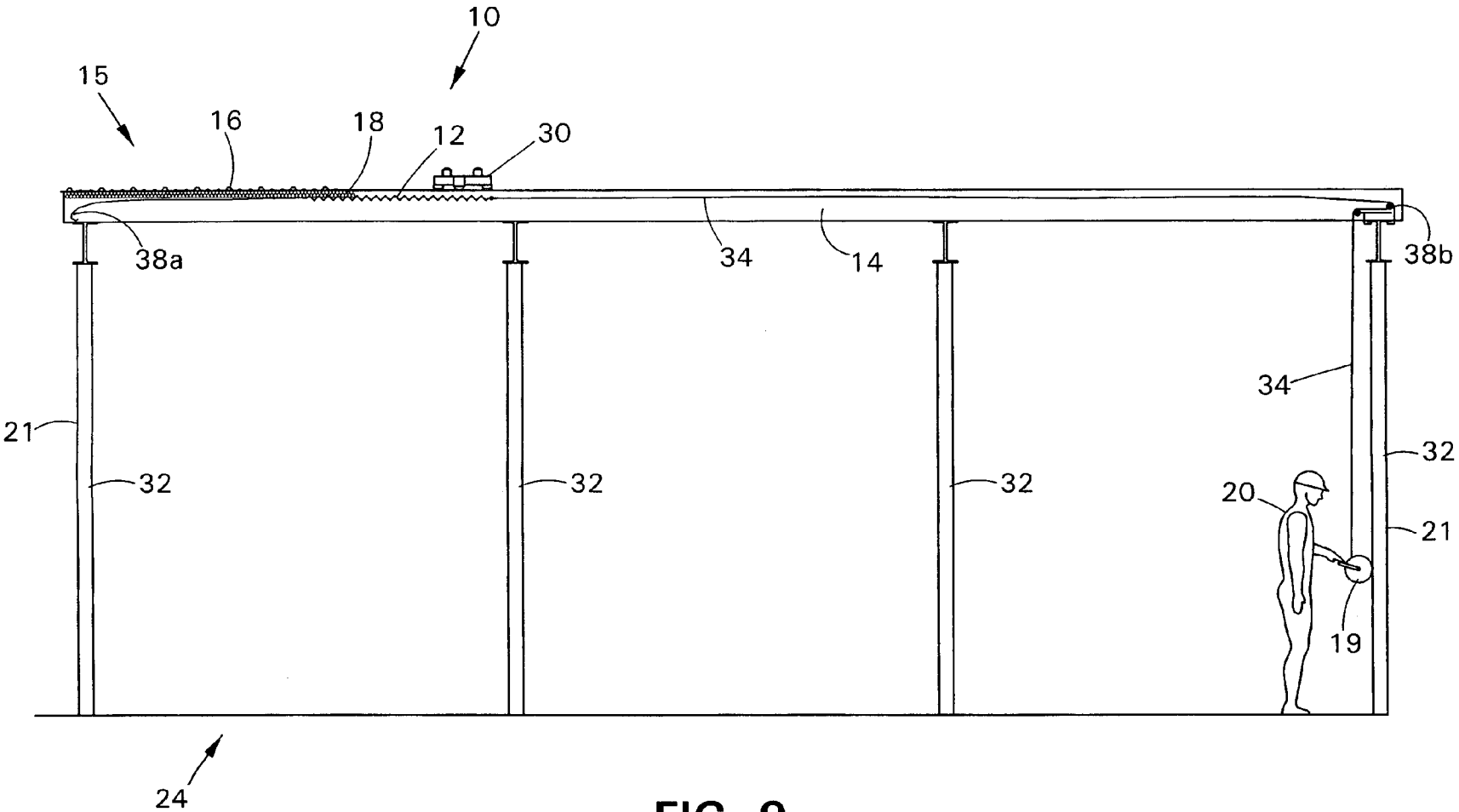
FIG. 9 is a side schematic view of the movable safety barrier system showing an embodiment of a cable arrangement.

In the building 24 depicted in FIGS. 7 and 8, the support beams 14 typically extend across the tops of a series of main frame members 32. The building 24 is covered with corrugated siding 25*a* and the eaves on the sides 23 include closure pieces 25*b* which are shaped to mate with and seal any corrugations in the roof panels 16. The length of the barrier member 12 of the movable safety barrier system 10 can be extended across substantially the width of the roof 15 of the building 24 over the peak with the width "W" extending forward from the leading edge of the construction to provide protection against falls for the workers 20. The ends 28 of the barrier member 12 can be positioned near the sides 23 of building 24. The ends 28 are slidably secured to a pair of cables 34 (FIGS. 8-10) which in turn are secured to opposite sides 23 of the building 24. Referring to FIG. 9, each cable 34 can be secured at an anchor point 38*a* on one end wall 21 and extend around a pulley assembly 38*b* on the opposite end wall 21 before extending down to a winch assembly 19. The winch assembly 19 allows tightening of the cable 34. For long buildings 24, the cables 34 can be extended only along part of the length of the building at one time, and if the building 24 is wide, some cables 34 can be positioned at inward locations. The distance between the ends 28 of the barrier member 12 can be maintained at a fixed distance by two opposed or parallel carriages 30 which travel on support beams 14 located near the cables 34 (FIGS. 10-13).

Figure 10:
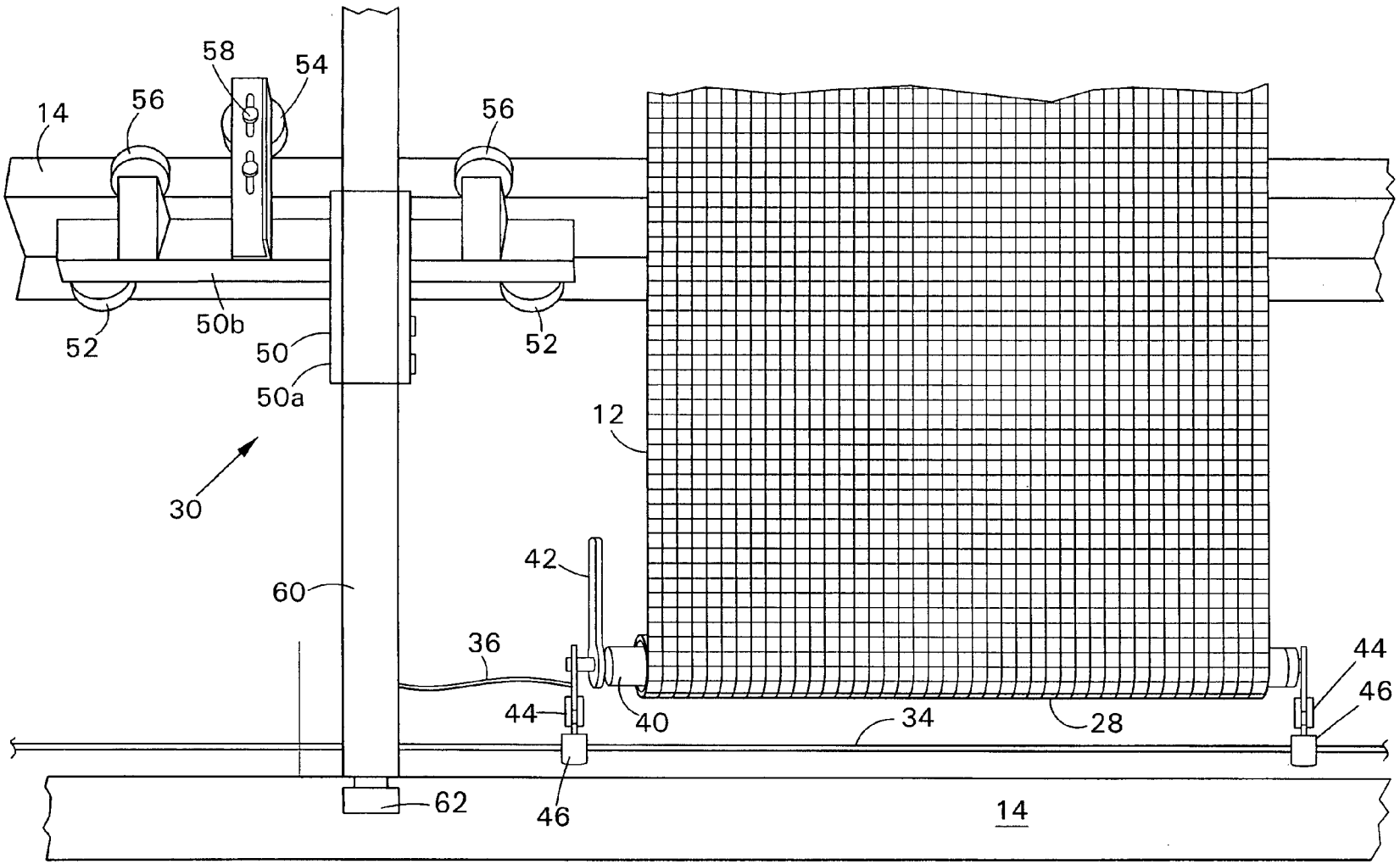
FIG. 10 is a top view of one end of the movable safety barrier system showing a portion of a movable carriage and the end of the barrier member slidably secured to a cable.
Figure 11:
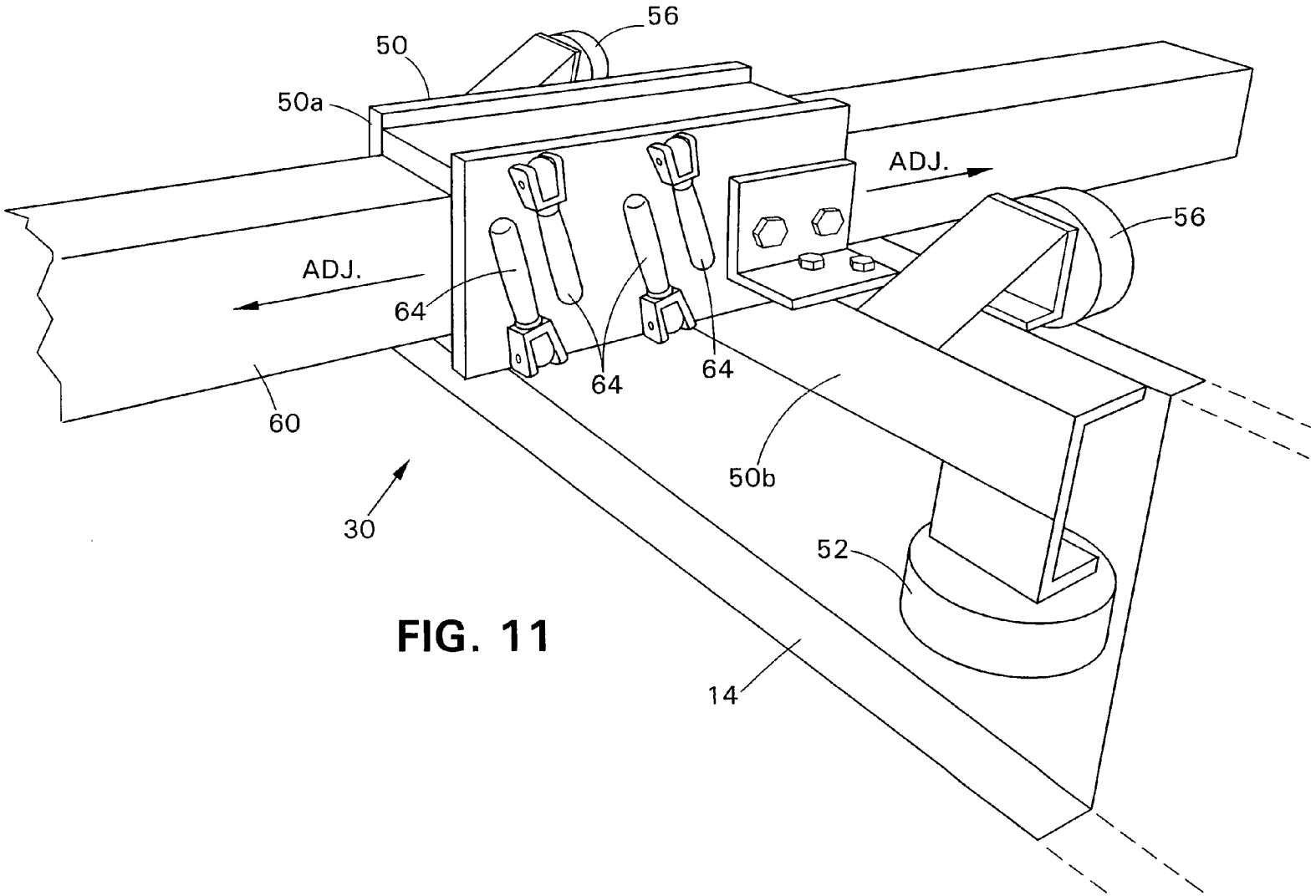
FIG. 11 is a perspective view of a roller assembly of a movable carriage.
Figure 12:
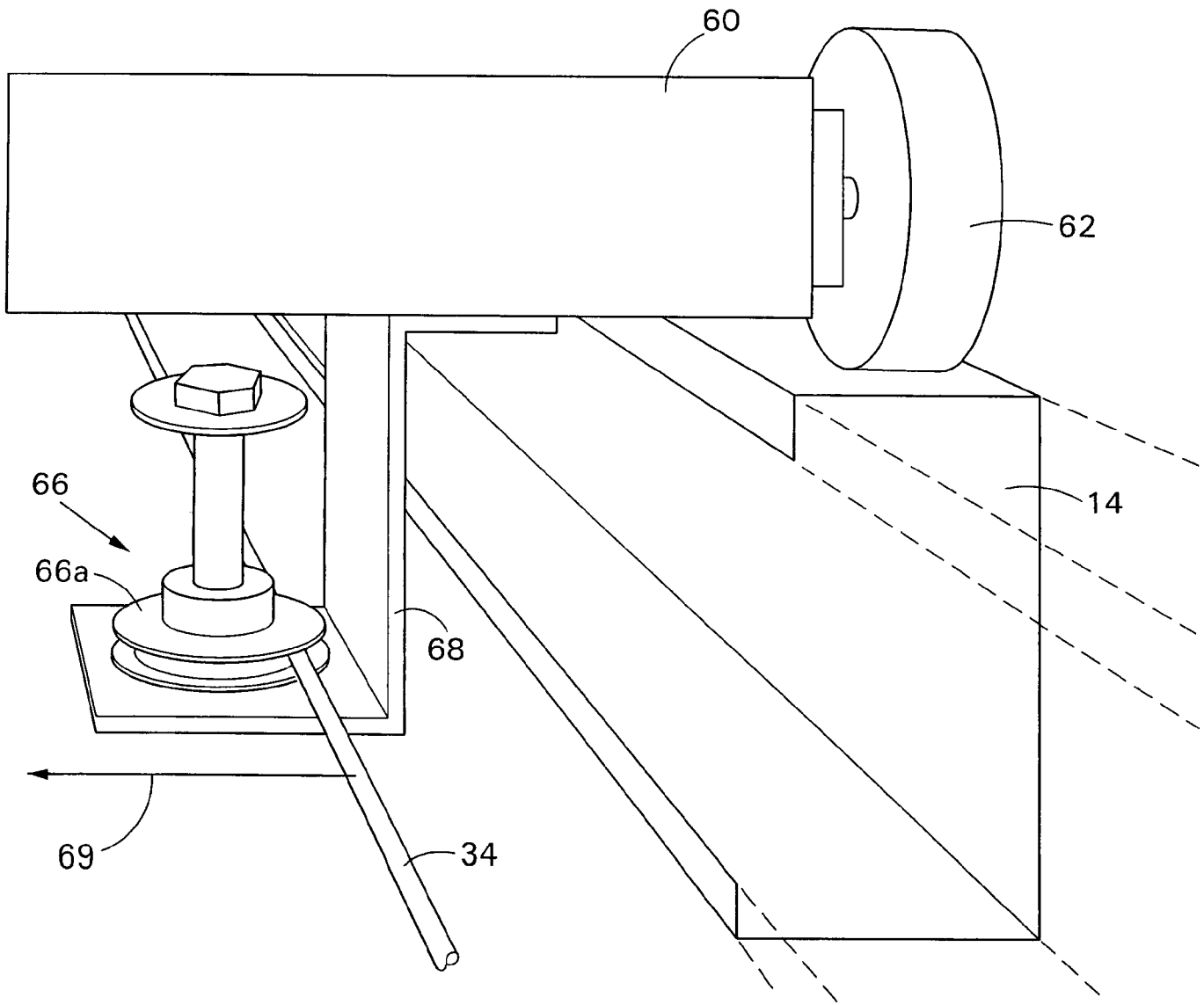
FIG. 12 is a perspective leading end view of a portion of the movable carriage showing an outboard top roller and a cable retention roller assembly.
Figure 13:
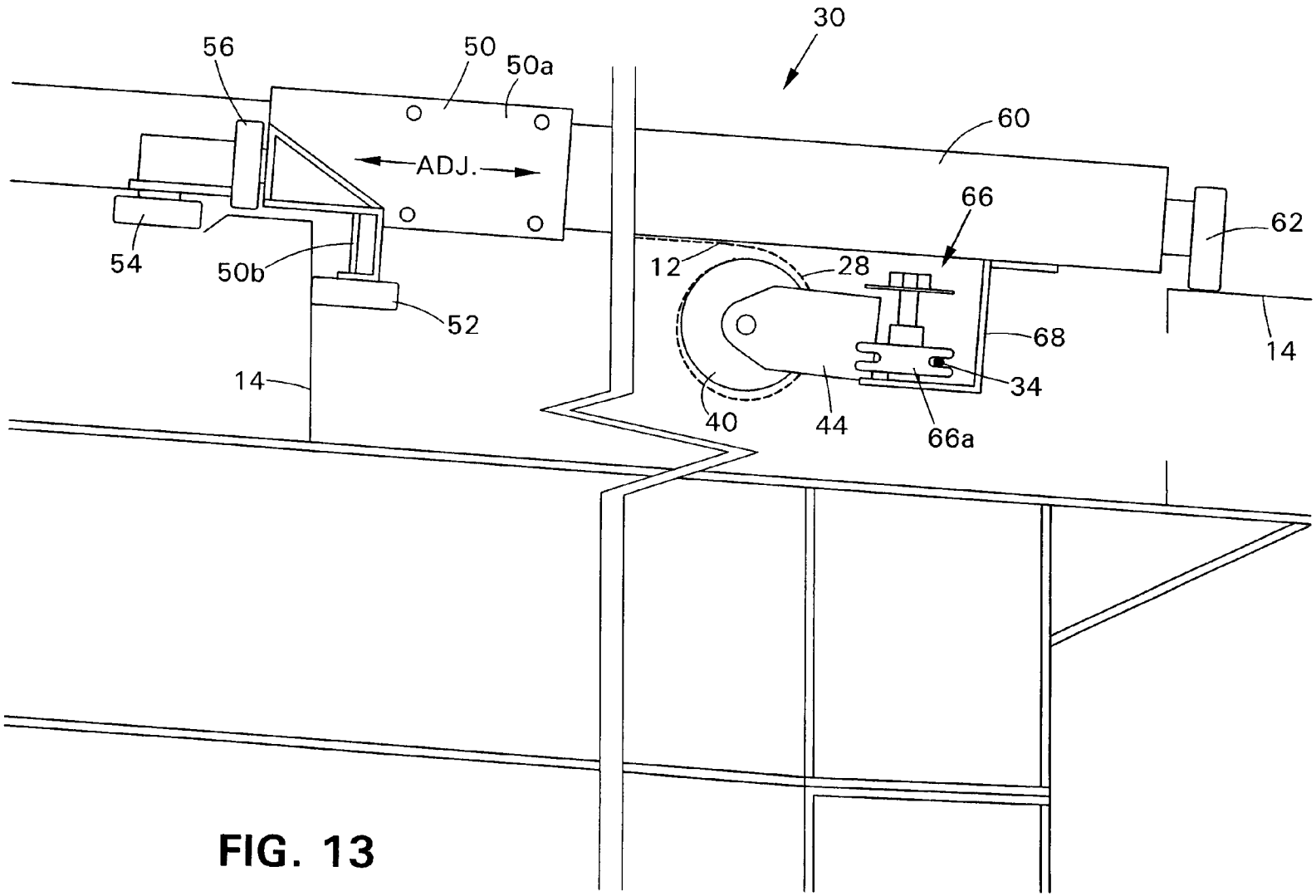
FIG. 13 is a leading end view of the carriage traveling on roof beams, with an end of the barrier member extending from a roll.

Each carriage 30 can have a cable retaining roller assembly 66 which is mounted to a carriage arm 60 of the carriage 30 by a bracket 68, and which engages a cable 34 with a grooved wheel 66*a* such as a pulley, to prevent lateral movement of the cable 34 inwardly in the direction of arrow 69 (FIG. 12). This also keeps the ends 28 of the barrier member 12 generally parallel to each other. The carriages 30 can be connected to the barrier member 12 by a connector 36 (FIGS. 8 and 10). Each carriage 30 also includes a roller system having a roller assembly 50 mounted to the carriage arm 60 for capturing and rolling along one support beam 14, and an outboard roller 62 extending from an end of the carriage arm 60 for engaging and rolling along the top of another support beam 14. The roller assembly 50 can have a cross piece 50*b* with two fixed lateral side rollers 52 spaced apart on one side and one adjustable lateral side roller 54 intermediately spaced on the opposite side for laterally engaging and capturing opposite sides of a support beam 14 in a rolling fashion, and two top rollers 56 spaced apart for engaging and riding on the top of the support beam 14 in a rolling fashion (FIGS. 10, 11 and 13). The roller assembly 50 is adjustably mounted to the carriage arm 60 by an adjustment sleeve 50*a* having a series of locking cams 64 (FIG. 11). The carriage arm 60 can be formed of square tubing, as shown. Rollers 52 and 56 can be positioned on opposite sides of carriage arm 60 by cross piece 50*b*. Although FIGS. 2 and 5 depicted the barrier member 12 as being advanced by a pole 26, alternatively, carriages 30 can be powered by motors, and be remotely controlled for advancing the barrier member 12.

The position of the roller assembly 50 can be adjusted along the carriage arm 60 to adjust for varying distances between support beams 14 from one building 24 or structure to the next. Loosening the locking cams 64 on the adjustment sleeve 50*a* allows the roller assembly 50 to be slid along the carriage arm 60, and tightening the locking cams 64 locks the roller assembly 50 in the desired position. The adjustment mechanism 58 for the adjustable lateral roller 54 provides adjustment towards and away from rollers 52 which allows the roller assembly 50 to be adjusted to accommodate support beams 14 of varying widths. When properly adjusted, the roller assembly 50 can move along a support beam 14 without significant twisting.

By having the outboard roller 62 of carriage 30 roll on the top of the support beam 14, the carriage 30 can travel over the support beams 14 without having to extend around or ride on the sides 23 of the building 24. This allows the siding 25*a* and closure pieces 25*b* to be installed before the roof panels 16 on the roof 15, without risk of damage by any lateral rollers riding on the sides 23. In the figures, the support members or beams 14 are shown as metal joists or purlins, but can be a variety of types of support beams such as I-beams, trusses, wood beams, etc.

One or both of the ends 28 of barrier member 12 can extend from rolls 40 (FIGS. 10 and 13). The rolls 40 are slidably mounted to the cables 34 by connecting members 44 extending from the ends of the rolls 40 and slide members 46. The slide members 46 can be pulleys. The connectors 36 extending between the carriage arms 60 and the connecting members 44 connect the carriages 30 to the barrier member 12. The connectors 36 can be flexible, for example, being made from a chain or a cable, or can be rigid. The carriages 30 can also be pushed for advancing the barrier member 12 forward.

A windup/unwind mechanism 42 can be connected to the rolls 40 for winding or unwinding the length of the barrier member 12, as well as for tightening the length of the barrier member 12 to the desired tension. The windup/unwind mechanism 42 can be a hand-operated device, such as a ratchet, or can be motorized. In some embodiments, the barrier member 12 can be extended from both rolls 40 on two sides and secured together. In other embodiments the barrier member 12 can be extended only from one roll 40 and secured to the opposite roll 40 or other suitable structure. As seen in FIG. 13, the barrier member 12 can extend over the top of the roll 40 so that if a worker 20 falls into or on top of the barrier member 12, the resultant tension is better resisted by the carriages 30.

Figure 14:
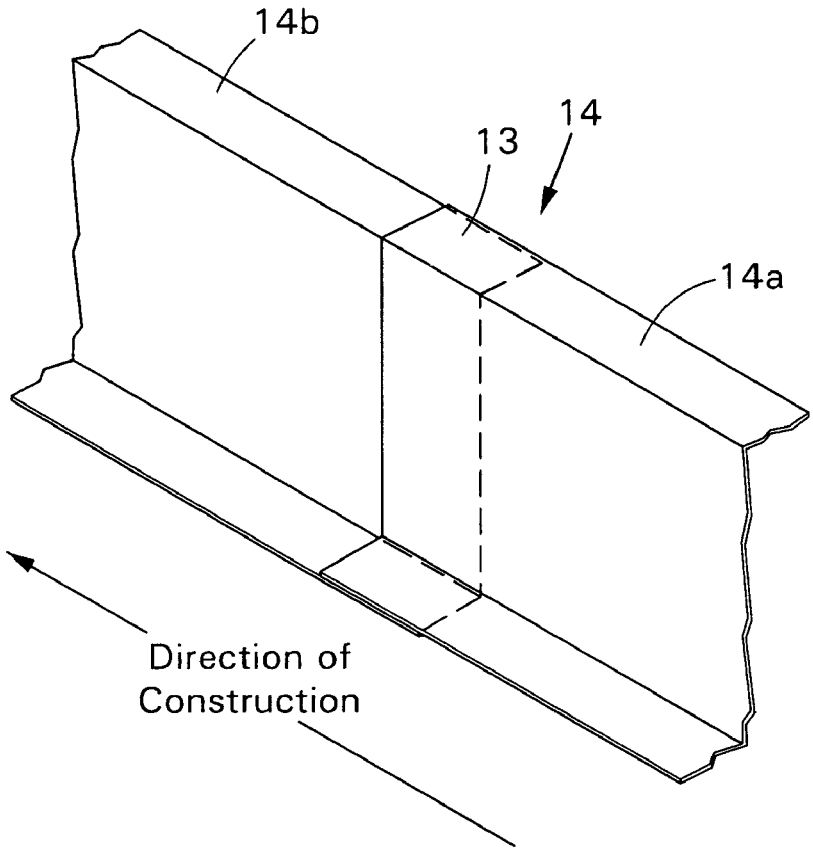
FIG. 14 is a perspective view of one configuration for joining metal roof beams together.

Referring to FIG. 14, the support beams 14, when metal purlins or joists, can be formed of overlapping lengths, for example, 14*a* and 14*b*, which are overlapped at a region 13. The length 14*a* can be overlapped over length 14*b* so that there is a step down, moving in the direction of construction. With such an overlap configuration, the barrier member 12 can be moved in the direction of construction without catching or getting hung up at region 13. If the lengths 14*a* and 14*b* are overlapped the opposite way, stepping up in the direction of construction, the overlapped region 13 can be treated, for example, with a piece of adhesive tape, to provide smooth sliding of the barrier member 12 over the step up.

Figure 15:
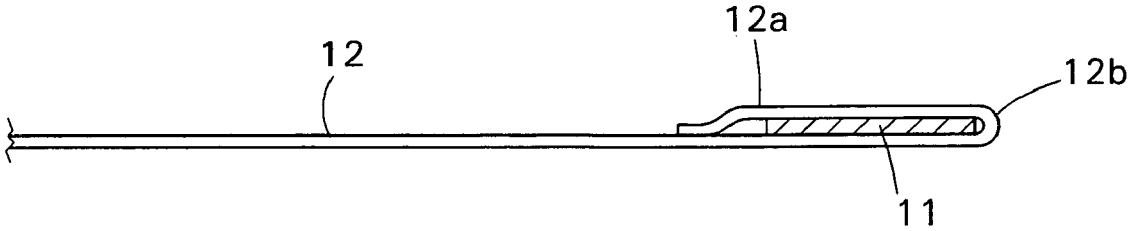
FIG. 15 is a side view of the leading edge of an embodiment of the barrier member.

Referring to FIG. 15, the barrier member 12 can be formed of netting material, such as a slippery plastic mesh which allows wind to easily pass through, to prevent billowing. This plastic mesh can be reinforced with a reinforcing member such as a thin plastic strip 11 to promote smoother or more even sliding of the leading edge 12*b* over the support beams 14. This can reduce the number of push points needed for advancing the barrier member 12. The reinforcing plastic strip 11 can be captured by folding over a portion 12*a* of the barrier member 12 material and stitching or sealing in place. The plastic strip 11 can be formed of suitable materials such as nylon, delrin, polytetrafluorethylene (PTFE), etc. Alternatively, the leading edge 12*b* can be reinforced integrally during the manufacturing of the barrier member 12. The trailing edge of the barrier member 12 can also be reinforced if desired. The barrier member 12 is typically flexible in both directions along the length and the width. Runners extending across the width "W" in the same direction and spacing as the support beams 14 are not required for promoting sliding on the support beams 14. However, if desired, stiffeners can be added across the width "W" of the barrier member 12. Such stiffeners can be flexible. In some applications, the width "W" of the barrier member 12 can be seven feet, such as when the roof panels 16 are three feet wide, the insulation is six feet wide, and where the barrier member 12 is meant to be positioned to be about one foot ahead of the insulation 18 without leaving a void between the roof panels 16 and the barrier member 12. It is understood that both the width "W" and the length of the barrier member 12 can vary depending upon the application at hand.

Although the barrier member 12 has been described to be made of a plastic mesh-type netting, it is understood that the barrier member 12 can be formed of other suitable materials such as maritime-type netting, woven and unwoven textiles, fabric sheets, plastic, laminates or composite sheets, tarp-type sheets, metallic screen materials, etc. For barrier members 12 of generally solid sheet construction, openings can be provided to allow the passage of wind. The barrier member 12 is typically formed of material that can satisfy OSHA regulations, for example, 400 lbs. being dropped into the barrier member 12. The material is also typically thin to allow the barrier member 12 to be rolled up on roll 40 without taking up a lot of space and to allow the barrier member 12 to slide easily when sandwiched between the roof panels 16, insulation 18 and support beams 14. In some embodiments, each roll 40 can hold about twenty to thirty feet of barrier member 12. Other embodiments can contain lesser or greater amounts. A thin material also allows the barrier member 12 to be light weight and carried easily by workers 20.

Figure 16:
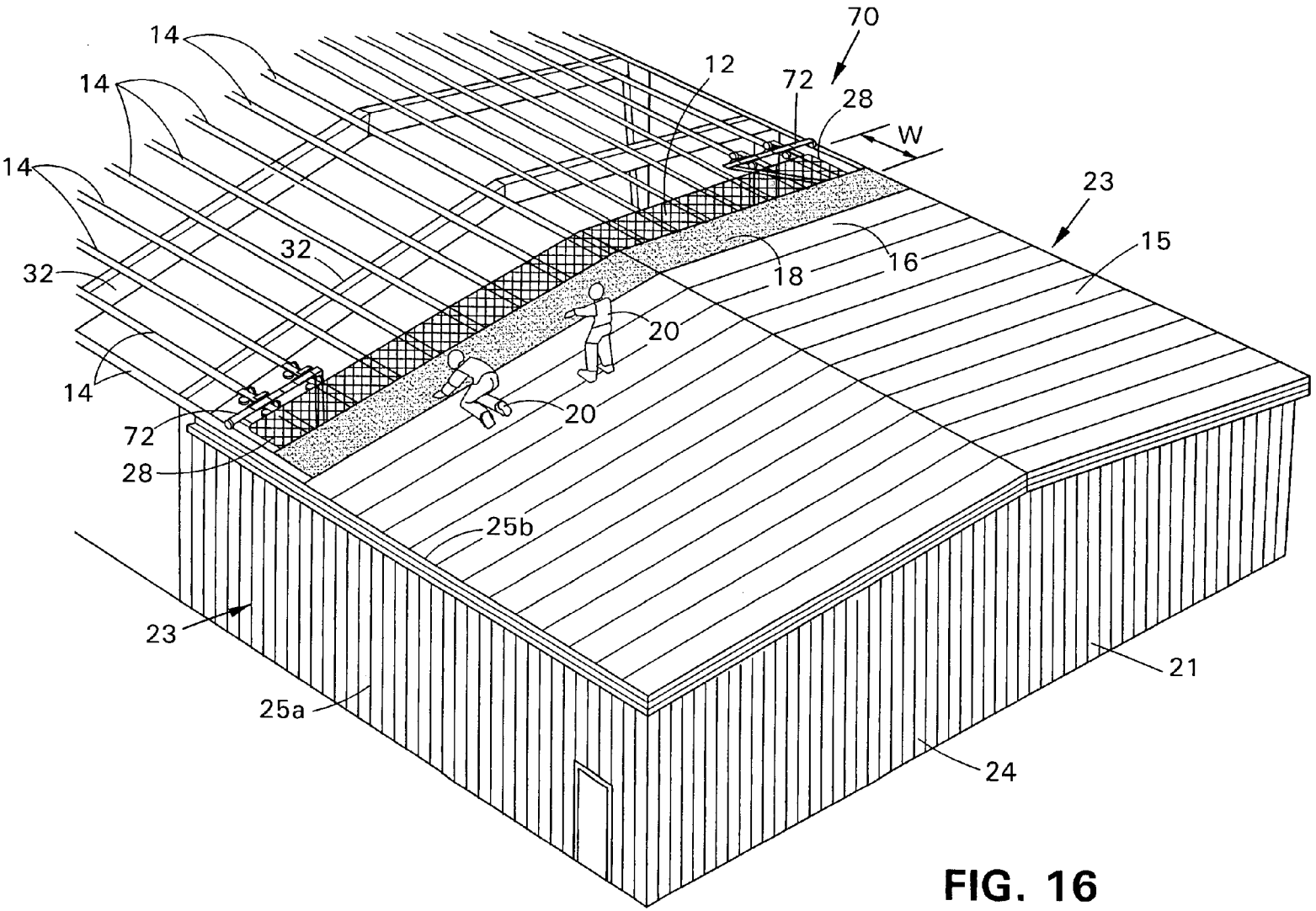
FIG. 16 is a perspective view of a roof being installed on a building with another embodiment of the present invention movable safety barrier system, in position at the leading edge of construction.
Figure 17:
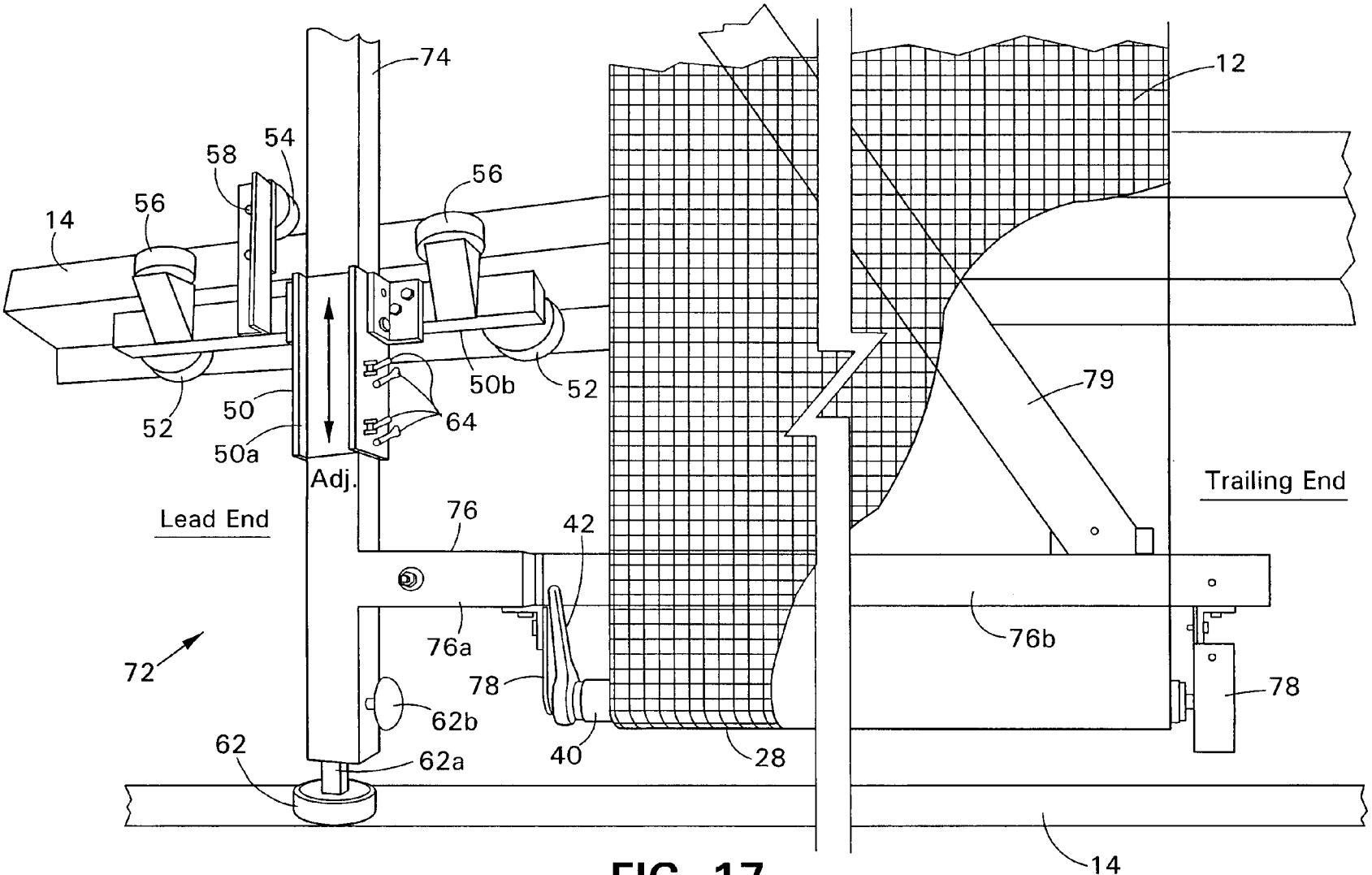
FIG. 17 is a top perspective view of a portion of one end of the embodiment of the movable safety barrier system of FIG. 16 showing the barrier member secured to a movable carriage traveling on roof beams.
Figure 18:
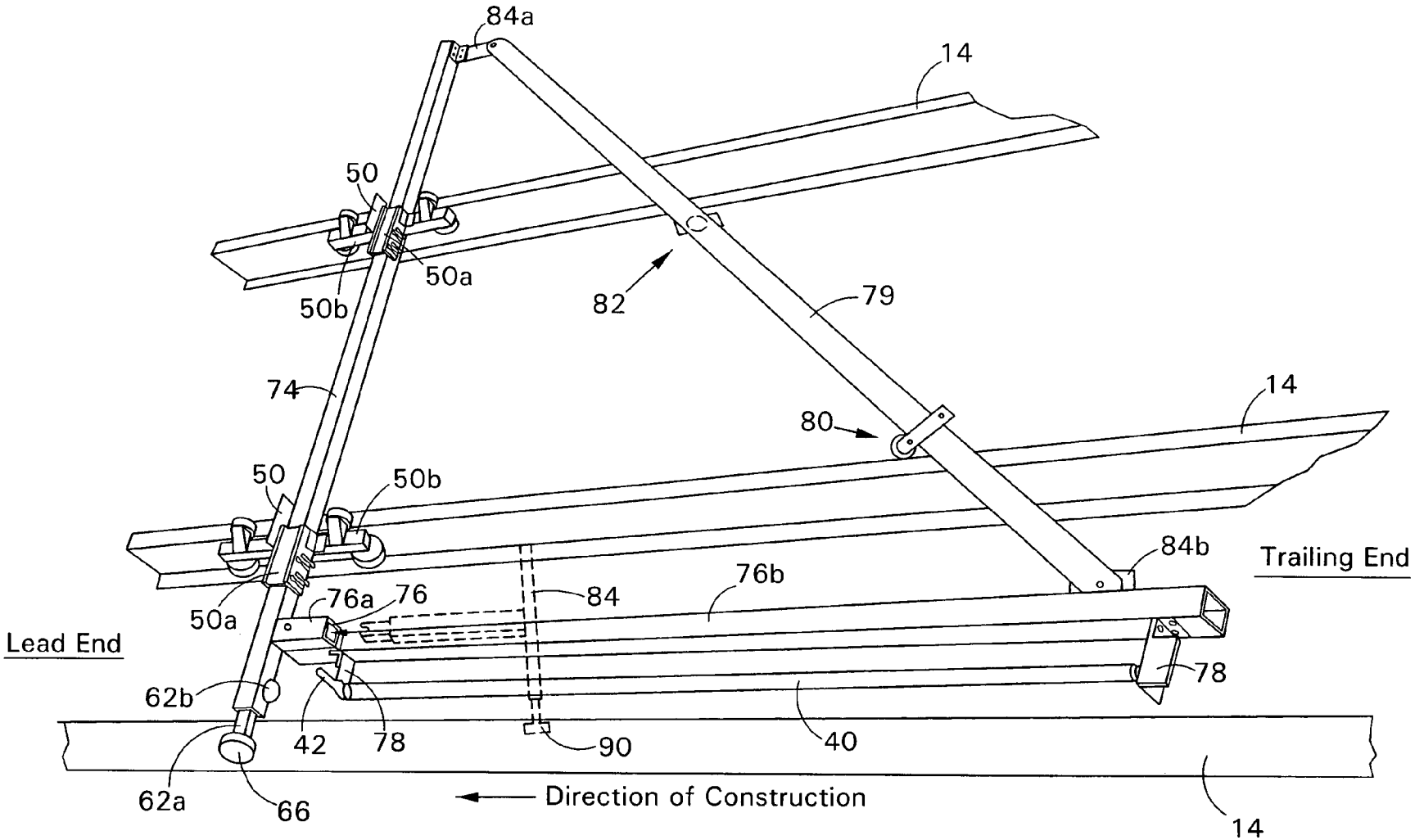
FIG. 18 is a top perspective view of the carriage of FIG. 17 traveling on roof beams, with the barrier member omitted.
Figure 19:
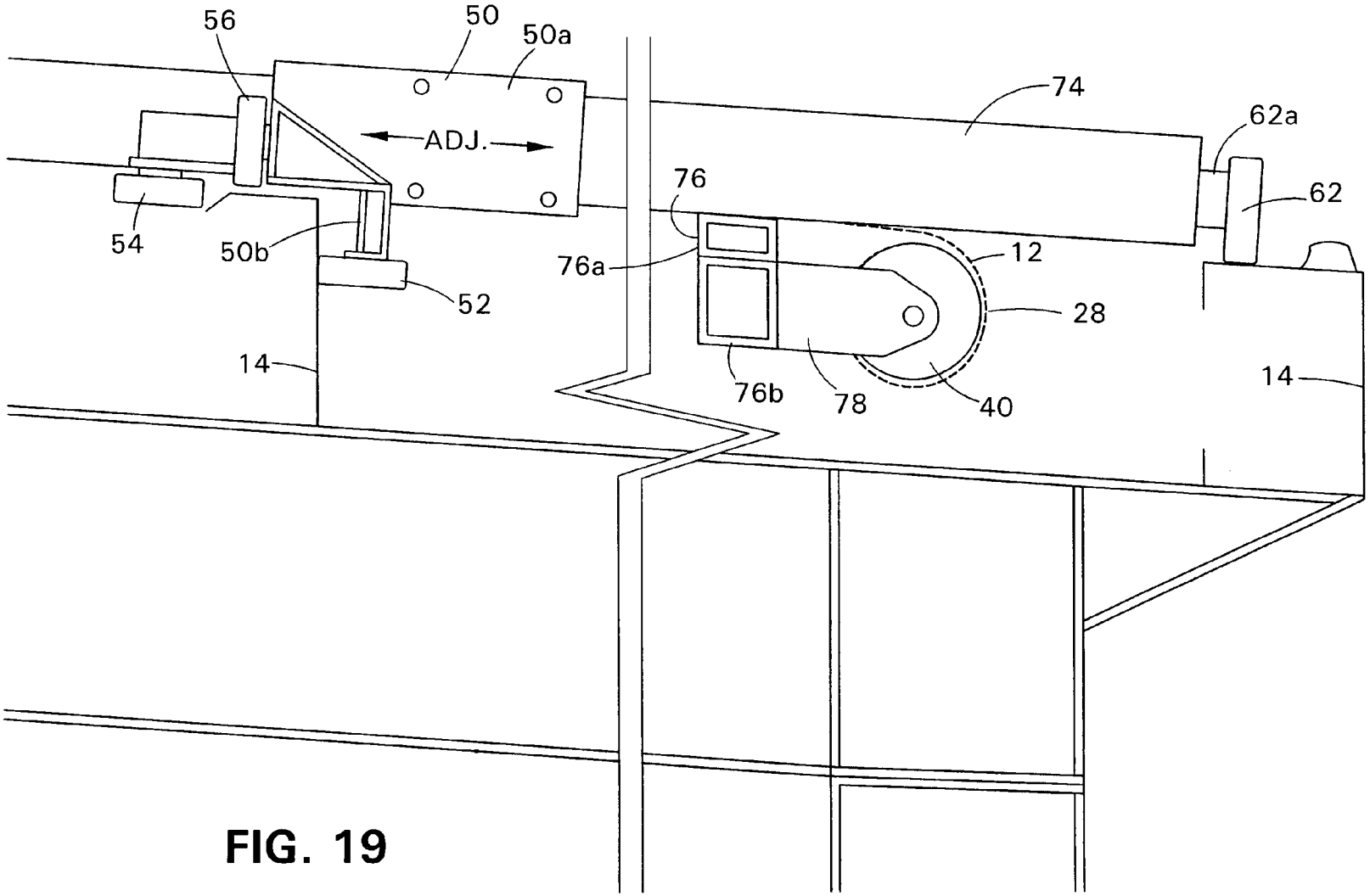
FIG. 19 is a leading end view of the carriage of FIG. 17 traveling on roof beams, with an end of the barrier member extending from a roll fixed to the carriage.

Referring to FIGS. 16-19, movable safety barrier system 70 is another embodiment in the present invention which differs form barrier system 10 in that the barrier system 70 includes two opposed or parallel carriages 72 having a construction where the cables 34 can be omitted and the ends 28 of the barrier member 12 can be mounted to the carriages 72 instead of to the cables 34. Referring to FIGS. 17-19, a roll 40 from which the barrier member 12 is extended, can be mounted to a carriage arm 76 of a carriage 72 by brackets 78. In the embodiment shown, carriage 72 has a generally triangular shape with carriage arm 76 being connected to carriage arms 74 and 79. Carriage arm 76 is positioned to be parallel to the support beams 14 and sides 23 of the building 24. The carriage arm 74 can be perpendicular to carriage arm 76 and is on the leading edge end of the carriage 72. The carriage arm 74 can have two roller assemblies 50 mounted along the length which are similar to those in safety barrier system 10 for capturing and riding or rolling along separate support beams 14. The roller assemblies 50 can resist twisting forces on the carriage 72. The roller assemblies 50 are slidably adjustable relative to carriage arm 74 to adjust for varying positions and distances between the support beams 14. The outboard top roller 62 can have an adjustable stem 62*a* extending from the end of carriage arm 74 for further adjustment purposes. A locking knob 62*b* can be included for locking the stem 62 in the desired position. Carriage arms 76 and 79 are on the trailing end of the carriage 72 with arm 79 forming the hypotenuse of the triangle.

As can be seen in FIG. 17, the barrier member 12 can extend over carriage arms 76 and 79. In order to allow the barrier member 12 to extend across the carriage 72 and be as close as possible to the support members 14, carriage arm 76 has a low profile or recessed distal portion 76*b* which steps down from a proximal portion 76*a*, and carriage arm 79 is positioned in a low profile or recessed manner by connecting brackets 84*a* and 84*b*. The low profile of carriage arms 76 and 79 is also desirable because the insulation 18 and roof panels 16 can extend over a portion of these carriage arms 76 and 79, and a low profile brings these portions of carriage arms 76 and 79 close to the level of the support beams 14 and allows the carriage arms 76 and 79 to slide easily out from under the insulation 18 and roof panels 16. The roll 40 can be mounted to the recessed distal portion 76*b* of the carriage arm 76, as seen in FIG. 19. While carriage arms 74 and 76 can be made of square tubing as shown, carriage arm 79 can be a thin bar or rod to aid in providing the low or recessed profile. Alternatively, selected carriage arms can be made of round tubing, as well as angle, channel or bar stock, etc. Typically, the structural components of both carriages 30 and 72 are made of aluminum for purposes of light weight, but can be made of any suitable material.

Figure 20:
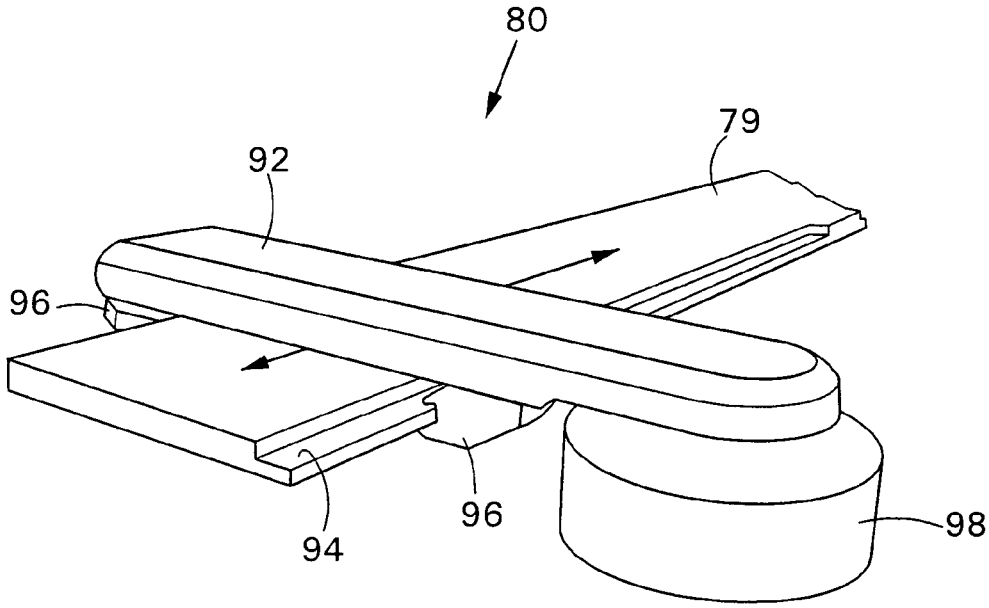
FIG. 20 is a perspective view of one roller assembly on the trailing end of the carriage of FIG. 17.

The carriage arm 79 can include roller assemblies 80 and 82 for rollably engaging the sides of separate support beams 14 and further resisting lateral twisting of carriage 72. Referring to FIG. 20, roller assembly 80 can have a lateral side roller 98 which is mounted to carriage arm 79 by bracket 92 and clamping fingers 96. Roller 98 can be mounted to extend adjacent to and below carriage arm 79. The carriage arm 79 can have steps 94 formed on opposite edges so that the bracket 92 and clamping fingers 96 can be mounted to the carriage arm 79 in a low profile manner. The position of the roller assembly 80 can be adjusted relative to the carriage arm 79 to adjust for different spacings and sizes of the support beams 14.

Figure 21:
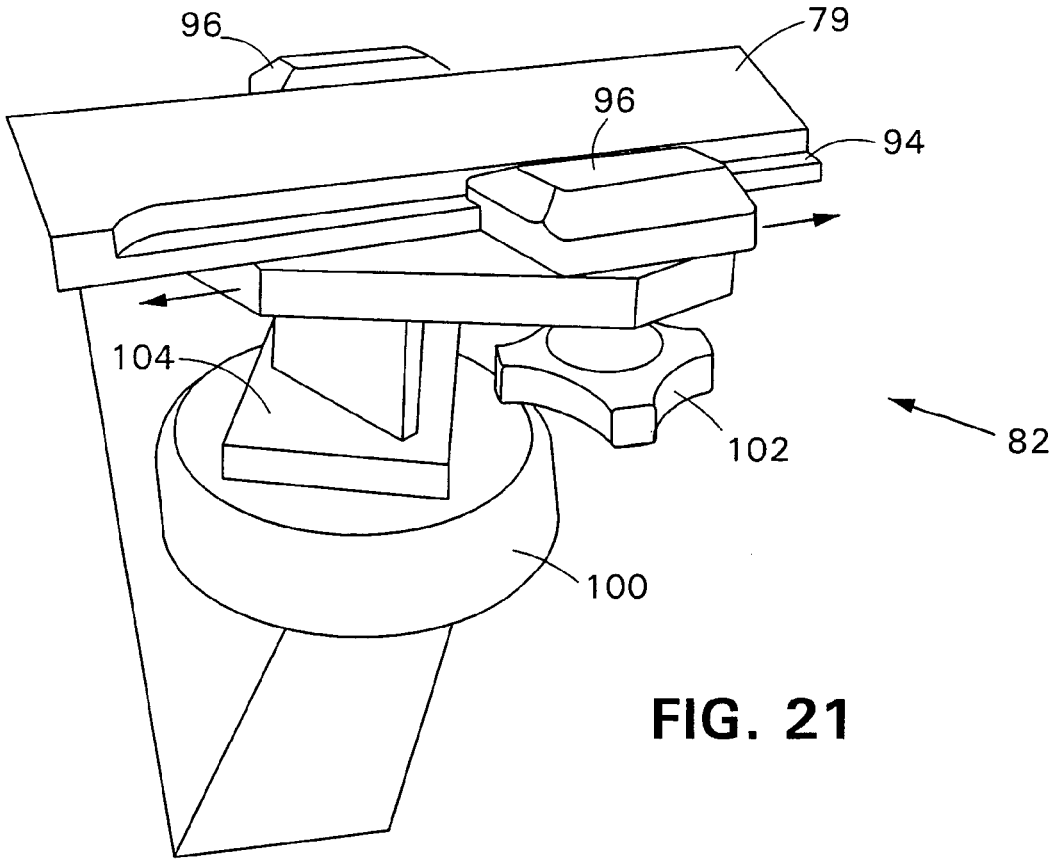
FIG. 21 is a perspective view of another roller assembly on the trailing end of the carriage of FIG. 17.

Referring to FIG. 21, roller assembly 82 can have a lateral side roller 100 which is mounted to carriage arm 79 by bracket 104 and clamping fingers 96. Roller 100 can be mounted below carriage arm 79. Adjustment knobs 102 can be used to loosen and tighten the clamping fingers 96 on the steps 94 for providing adjustment of the position of roller assembly 82 relative to carriage arm 79 to allow for different spacings and sizes of the support beams 14. The adjustment knobs 102 can also be employed with roller assembly 80. The use of roller assemblies 80 and 82 can depend upon the type and configuration of the support beams 14. Some configurations of the support beams 14 may allow more than one roller assembly 80 or more than one roller assembly 82, in a variety of combinations. In addition, the roller assemblies 80 and 82 can be of other suitable configuration than those shown, and can have vertical adjustment capabilities and vertical rollers. As with carriages 30, carriages 72 can be powered by motors and remotely operated.

Figure 22:
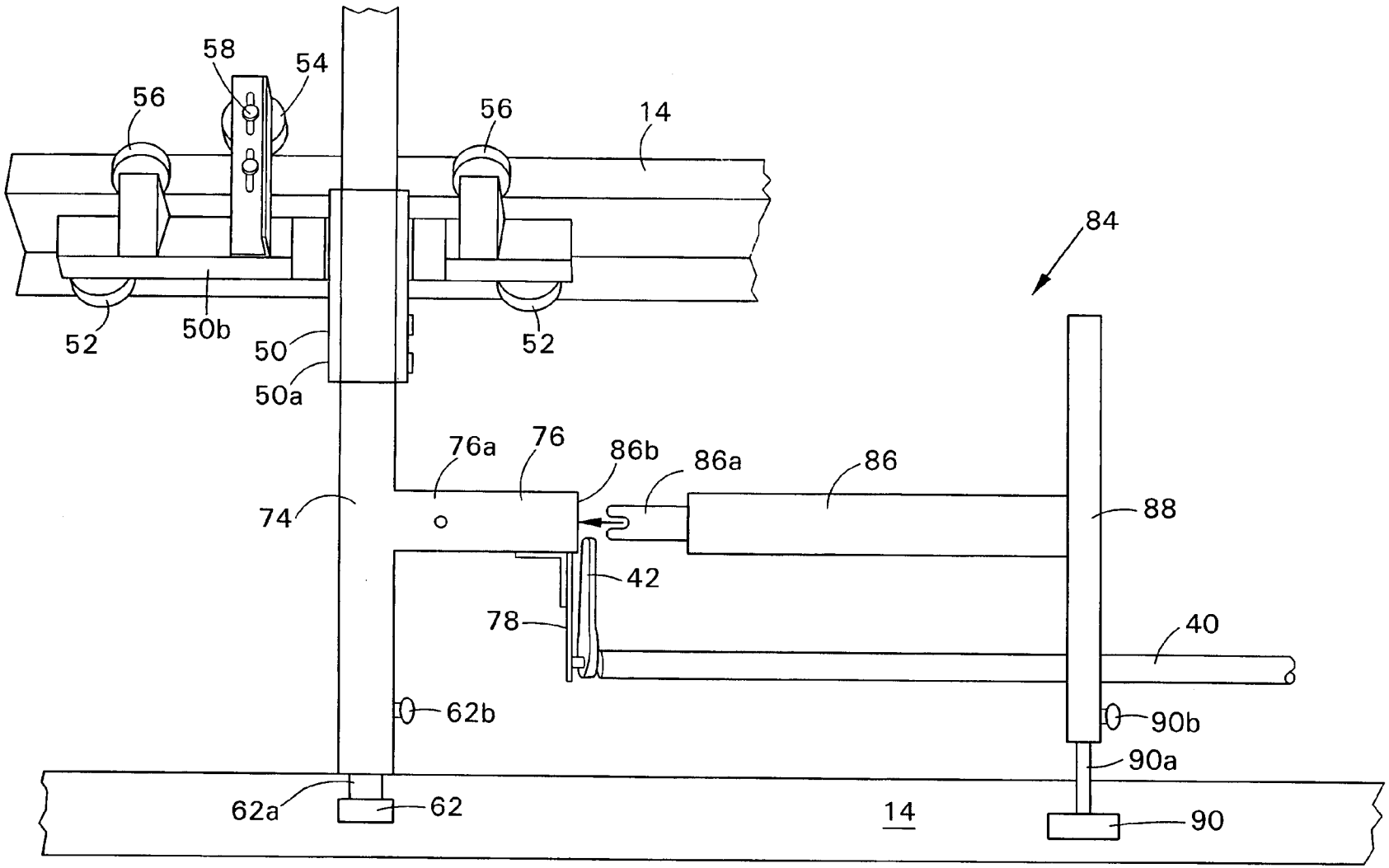
FIG. 22 is a top perspective view of a portion of the carriage of FIG. 17 showing an optional roller assembly.

Referring to FIGS. 18 and 22, the carriage 72 can optionally include an auxiliary outboard roller assembly 84 having a top outboard roller 90 which rides over the top of the same support beam 14 as outboard roller 62, but is spaced apart from roller 62. The auxiliary roller assembly 84 can provide further stability for the carriage 72 and further support the trailing end of the carriage 72. The auxiliary roller assembly 84 can be secured to the carriage arm 76, for example, at the proximal portion 76*a*, where a protrusion 86*a* locks within a mating socket 86*b*. The auxiliary roller assembly 84 has a longitudinal spacing arm 86 and a cross arm 88 which positions the outboard roller 90 spaced apart from, and generally in line with roller 62. The outboard roller 90 can have an adjustment stem 90*a* for adjusting the position of the outboard roller 90 and a locking knob 90*b* for locking the stem 90*a* in the desired position.

Figure 23:
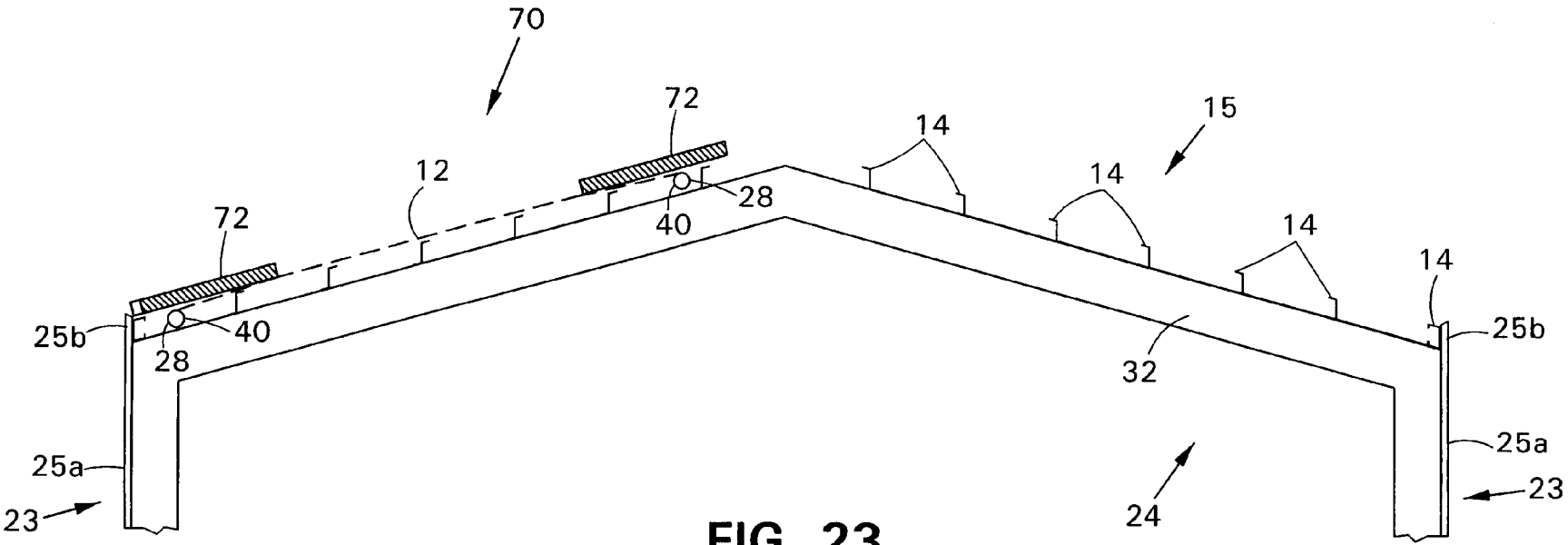
FIG. 23 is an end schematic view of a roof with the movable carriages of the movable safety barrier system of FIG. 16 being positioned on one half of the roof.

FIG. 23 depicts the use of movable safety barrier system 70 on one side of the roof 15 or peak of a building 24. This can be a construction style decision, or based on the length of the barrier member 12. The construction of the carriages 72 allows the barrier member 12 to be positioned near the sides 23 of the building 24 without engaging surfaces of the sides 23, so that the siding 25*a* and closure pieces 25*b* do not become damaged.

Figure 24:
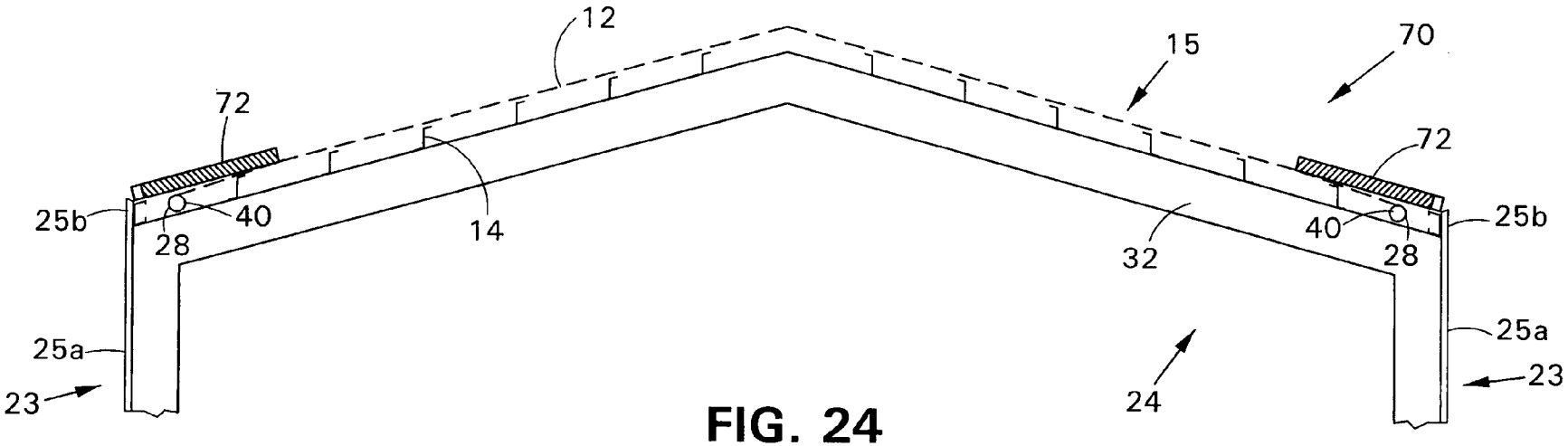
FIG. 24 is an end schematic view of a roof with the movable carriages of the movable safety barrier system of FIG. 16 being positioned on opposite sides of the roof.
Figure 25:
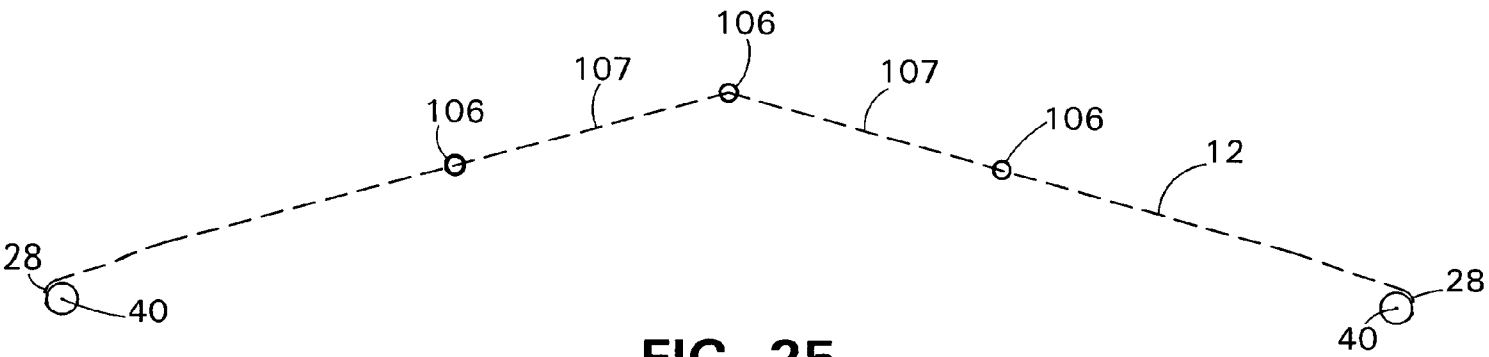
FIG. 25 is a schematic drawing of the safety barrier system of FIG. 16 showing the safety barrier member extending from rolls of two carriages and including extension segments.

FIG. 24, depicts the movable safety barrier system 70 being positioned across the width of the roof 15 such as seen in FIG. 16. In cases where the width across the roof 15 is greater than the length of the barrier member 12 stored on the carriages 72, one or more extension segments 107 can be used for increasing the length of the barrier member 12 (FIG. 25). The segments 107 can be connected by a series of fasteners such as rings 106 to each other, and the portions of the barrier member 12 which extend from the rolls 40. The rings 106 can have spring loaded entrance portions. In example, if the rolls 40 each hold thirty feet of barrier member material, the total length of the barrier member 12 can be sixty feet plus the length of the extension segments 107 used.

While this invention has been particularly shown and described with references to particular embodiments thereof, it will be understood by those skilled in the art that various changes in form and details may be made therein without departing from the scope of the invention encompassed by the appended claims.

For example, although the present invention has been mostly described for use when installing insulation and corrugated roof panels on a shallow sloped roof, it is understood that the present invention can be used on a variety of elevated structures for the installation of a number of different components. The surfaces can be flat as well as sloped. In addition, carriages 30 and 70 can have other shapes and configurations than those shown, depending upon the situation at hand. A variety of different roller systems and roller assemblies are possible. Furthermore, various features of the embodiments discussed above can be omitted or combined.

What is claimed is:

1. A movable safety barrier system comprising:

a flexible light weight barrier member having a barrier member length with first and second ends, and a width W, the barrier member comprising flexible material, the length of the barrier member for extending across and moving sideways relative to the length over support members of a structure;

first and second end supports supporting respective first and second ends of the length of the barrier member, the length of the barrier member being extended between the end supports, the end supports configured for independent travel relative to separate spaced apart support members of the structure, and supporting the ends of the length of the barrier member in a manner that the length of the barrier member extending between the end supports is movable sideways relative to the length, at least one end support comprising a supply roll for storing at least a portion of the flexible barrier member; and first and second opposed movable carriages connected to respective first and second end supports, each carriage having a roller system with at least two spaced apart roller assemblies configured for engaging and traveling over top surfaces of at least two support members of the structure, the roller assemblies being secured to a lateral carriage member on a lead travel end of the carriage, the lateral carriage member configured for closely traveling over and above said at least two support members of the structure, said supply roll being mounted and positioned at a trailing end of at least one carriage perpendicular to and below the lateral carriage member by being mounted to a recessed mounting arrangement, the recessed mounting arrangement being connected to and being located below the lateral carriage member, wherein each carriage further comprises two carriage members connected to the lateral carriage member forming a generally triangular shape, the flexible barrier member, for extending over said two carriage members of the triangle, said two carriage members having recessed top surfaces to allow the barrier member to extend closer to the support members of the structure.

2. The barrier system of claim 1 in which the flexible barrier member comprises netting material.

3. The barrier system of claim 2 in which the netting material is a slippery plastic mesh type material.

4. The barrier system of claim 3 in which the width of the flexible barrier member has a leading edge, the leading edge being reinforced to allow the barrier member to slide more evenly across the support members of the structure.

5. The barrier system of claim 4 in which the leading edge is reinforced with a thin plastic member.

6. The barrier system of claim 1 in which the carriages maintain a fixed distance between the first and second ends of the length of the flexible barrier member when extended.

7. The barrier system of claim 1 in which the roller system comprises a series of side rollers and top rollers.

8. The barrier system of claim 7 in which selected rollers are adjustable for adjusting to different sizes and spacings of the support members of the structure.

9. The barrier system of claim 8 in which the roller system includes at least one roller assembly for capturing and traveling along a selected support member of the structure, said at least one roller assembly comprising opposed side rollers, and top rollers, the position of said at least one roller assembly being adjustable relative to the carriage.

10. The barrier system of claim 1 in which said roll from which the flexible barrier member extends is connected to a windup/unwind mechanism capable of locking in selected positions for selecting tension of the barrier member.

11. A movable safety barrier system comprising:

a flexible light weight barrier member having a barrier member length with first and second ends, and a width W, the barrier member comprising flexible material, the length of the barrier member for extending across and moving sideways relative to the length over support members of a structure, and extending from at least one end, from a supply roll;

first and second end supports supporting respective first and second ends of the length of the barrier member, the length of the barrier member being extended between the end supports, the end supports configured for independent travel relative to separate spaced apart support members of the structure, and supporting the ends of the length of the barrier member in a manner that the length of the barrier member extending between the end supports is movable sideways relative to the length;

a windup/unwind mechanism connected to said roll capable of locking in selected positions for selecting tension of the barrier member; and first and second opposed movable carriages connected to respective first and second end supports, each carriage having a roller system with at least two spaced apart roller assemblies configured for engaging and traveling over top surfaces of at least two support members of the structure, the roller assemblies being secured to a lateral carriage member on a lead travel end of the carriage, the lateral carriage member configured for closely traveling over and above said at least two support members of the structure, said supply roll being mounted and positioned at a trailing end of at least one carriage perpendicular to and below the lateral carriage member by being mounted to a recessed mounting arrangement, the recessed mounting arrangement being connected to and being located below the lateral carriage member, wherein each carriage further comprises two carriage members connected to the lateral carriage member forming a generally triangular shape, the flexible barrier member, for extending over said two carriage members of the triangle, said two carriage members having recessed top surfaces to allow the barrier member to extend closer to the support members of the structure.

12. A method of forming a movable safety barrier system comprising:

providing a flexible light weight barrier member having a barrier member length with first and second ends, and a width W, the barrier member comprising flexible material, the length of the barrier member for extending across and moving sideways relative to the length over support members of a structure; and supporting respective first and second ends of the length of the barrier member while the length of the barrier member is extended, between first and second end supports, the end supports configured for independent travel relative to separate spaced apart support members of the structure, and supporting the ends of the length of the barrier member in a manner that the length of the barrier member extending between the end supports is movable sideways relative to the length, at least one end support comprising a supply roll for storing at least a portion of the flexible barrier member, first and second opposed movable carriages being connected to respective first and second end supports, each carriage having a roller system with at least two spaced apart roller assemblies configured for engaging and traveling over top surfaces of at least two support members of the structure, the roller assemblies being secured to a lateral carriage member on a lead travel end of the carriage, the lateral carriage member configured for closely traveling over and above said at least two support members of the structure, said supply roll being mounted and positioned as a trailing end of at least one carriage perpendicular to and below the lateral carriage member by being mounted to a recessed mounting arrangement, the recessed mounting arrangement being connected to and being located below the lateral carriage member, wherein each carriage further comprises two carriage members connected to the lateral carriage member forming a generally triangular shape, the flexible barrier member, for extending over said two carriage members of the triangle, said two carriage members having recessed top surfaces to allow the barrier member to extend closer to the support members of the structure.

13. The method of claim 12 further comprising forming the flexible barrier member from netting material.

14. The method of claim 13 further comprising forming the netting material from slippery plastic mesh type material.

15. The method of claim 14 in which the width of the flexible barrier member has a leading edge, the method further comprising reinforcing the leading edge to allow the barrier member to slide more evenly across the support members of the structure.

16. The method of claim 15 further comprising reinforcing the leading edge with a thin plastic member.

17. The method of claim 12 further comprising maintaining a fixed distance between the first and second ends of the length of the flexible barrier member while extended with the first and second movable carriages.

18. The method of claim 12 further comprising providing the roller system with a series of side rollers and top rollers.

19. The method of claim 18 further comprising providing selected rollers with adjustability for adjusting to different sizes and spacings of the support members of the structure.

20. The method of claim 19 further comprising providing the roller system with at least one roller assembly for capturing and traveling along a selected support member of the structure, said at least one roller assembly comprising opposed side rollers, and top rollers, the position of said at least one roller assembly being adjustable relative to the carriage.

21. The method of claim 12 further comprising connecting said roll from which the flexible barrier member extends to a windup/unwind mechanism capable of locking in selected positions for selecting tension of the barrier member.

22. A method of forming a movable safety barrier system comprising:

providing a flexible light weight barrier member having a barrier member length with first and second ends, and a width W, the harrier member comprising flexible material, the length of the barrier member for extending across and moving sideways relative to the length over support members of a structure, and extending from at least one end from a supply roll;

supporting respective first and second ends of the length of the barrier member while the length of the barrier member is extended, between first and second end supports, the end supports configured for independent travel relative to separate spaced apart support members of the structure, and supporting the ends of the length of the barrier member in a manner that the length of the barrier member extending between the end supports is movable sideways relative to the length, first and second opposed movable carriages being connected to respective first and second end supports, each carriage having a roller system with at least two spaced apart roller assemblies configured for engaging and traveling over top surfaces of at least two support members of the structure, the roller assemblies being secured to a lateral carriage member on a lead travel end of the carriage, the lateral carriage member configured for closely traveling over and above said at least two support members of the structure, said supply roll being mounted and positioned at a trailing end of at least one carriage perpendicular to and below the lateral carriage member by being mounted to a recessed mounting arrangement, the recessed mounting arrangement being connected to and being located below the lateral carriage member; and connecting a windup/unwind mechanism to said roll, the mechanism capable of locking in selected positions for selecting tension of the barrier member, wherein each carriage further comprises two carriage members connected to the lateral carriage member forming a generally triangular shape, the flexible barrier member, for extending over said two carriage members of the triangle, said two carriage members having recessed top surfaces to allow the barrier member to extend closer to the support members of the structure.

23. A method of providing protection against falls with a movable safety barrier system when installing construction components over support members of a structure, comprising:

positioning over the support members of the structure a flexible light weight barrier member having a barrier member length with first and second ends, and a width W, the barrier member comprising flexible material, the length of the barrier member for extending across and moving sideways relative to the length over support members of a structure, the barrier member extending forward of a leading edge of construction;

supporting respective first and second ends of the length of the barrier member while the length of the barrier member is extended, between first and second end supports, the end supports configured for independent travel relative to separate spaced apart support members of the structure, and supporting the ends of the length of the barrier member in a manner that the length of the barrier member extending between the end supports is movable sideways relative to the length, at least one end support comprising a supply roll for storing at least a portion of the flexible barrier member, first and second opposed movable carriages being connected to respective first and second end supports, each carriage having a roller system with at least two spaced apart roller assemblies configured for engaging and traveling over top surfaces of at least two support members of the structure, the roller assemblies being secured to a lateral carriage member on a lead travel end of the carriage, the lateral carriage member configured for closely traveling over and above said at least two support members of the structure, said at least one supply roll being mounted and positioned at a trailing end of at least one carriage perpendicular to and below the lateral carriage member by being mounted to a recessed mounting arrangement, the recessed mounting arrangement being connected to and being located below the lateral carriage member;

positioning the construction components over the support members of the structure with portions extending over part of the barrier member; and moving the position of the barrier member forward by an amount that allows additional construction components to be positioned over the support members of the structure with portions extending over a part of the barrier member wherein the width of the barrier member still extends forward of the construction components, wherein each carriage further comprises two carriage members connected to the lateral carriage member forming a generally triangular shape, the flexible barrier member, for extending over said two carriage members of the triangle, said two carriage members having recessed top surfaces to allow the barrier member to extend closer to the support members of the structure.

* * * * *

UNITED STATES PATENT AND TRADEMARK OFFICE

CERTIFICATE OF CORRECTION

PATENT NO. : 7,665,576 B2
APPLICATION NO. : 10/983332
DATED : February 23, 2010
INVENTOR(S) : Richard C. Pelletier It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 986 days.

Signed and Sealed this

Seventh Day of December, 2010

David J. Kappos

David J. Kappos
*Director of the United States Patent and Trademark Office*